US007768401B2

(12) United States Patent
Nagai et al.

(10) Patent No.: US 7,768,401 B2
(45) Date of Patent: Aug. 3, 2010

(54) PLACE-STATUS MANAGEMENT SYSTEM, RADIO TAG READER, AND MANAGING APPARATUS

(75) Inventors: Yukimasa Nagai, Tokyo (JP); Hiroyoshi Suga, Tokyo (JP)

(73) Assignee: Mitsubishi Electric Corporation

( * ) Notice: Subject to any disclaimer, the term of this patent is extended or adjusted under 35 U.S.C. 154(b) by 445 days.

(21) Appl. No.: 11/628,660

(22) PCT Filed: Jul. 29, 2004

(86) PCT No.: PCT/JP2004/010843

§ 371 (c)(1),
(2), (4) Date: Dec. 6, 2006

(87) PCT Pub. No.: WO2006/011215

PCT Pub. Date: Feb. 2, 2006

(65) Prior Publication Data

US 2007/0247315 A1 Oct. 25, 2007

(51) Int. Cl.
*G08B 13/14* (2006.01)

(52) U.S. Cl. ..... 340/572.1; 235/375; 340/10.1

(58) Field of Classification Search ... 340/572.1–572.9, 340/10.1, 10.31, 10.32; 235/375–385
See application file for complete search history.

(56) References Cited

U.S. PATENT DOCUMENTS 4,361,202 A * 11/1982 Minovitch ..... 180/168
5,151,684 A * 9/1992 Johnsen ..... 340/568.1
5,432,508 A 7/1995 Jackson
5,883,582 A * 3/1999 Bowers et al. ..... 340/10.2
6,232,877 B1 * 5/2001 Ashwin ..... 340/572.1
6,272,224 B1 8/2001 Mazourenko et al.
RE37,467 E * 12/2001 Brasch et al. ..... 340/541
6,427,913 B1 8/2002 Maloney
6,885,311 B2 * 4/2005 Howard et al. ..... 340/932.2
7,081,818 B2 * 7/2006 Eckstein et al. ..... 340/572.1
2003/0002674 A1 1/2003 Nambu et al.
2003/0201321 A1 * 10/2003 Maloney ..... 235/384
2006/0187043 A1 * 8/2006 Allen ..... 340/572.1

FOREIGN PATENT DOCUMENTS

DE 39 04 826 C1 9/1990
JP 2-257400 A 10/1990
JP 9-311998 A 12/1997

(Continued)

OTHER PUBLICATIONS

H. Kosaka et al., Electronic Letters, Aug. 7, 2003, vol. 39 No. 16.

*Primary Examiner*—Davetta W Goins
*Assistant Examiner*—Edny Labbees
(74) *Attorney, Agent, or Firm*—Birch, Stewart, Kolasch, & Birch, LLP.

(57) ABSTRACT

A radio tag is arranged in each of a plurality of radio tag areas. The radio tag areas can be parking lots. A radio tag reader is configured to perform radio communications with the radio tags. The radio tag reader performs radio communications with each radio tag and based on the radio communication determines whether an object, which can be a vehicle, is present in the radio tag area corresponding to the radio tag.

8 Claims, 17 Drawing Sheets

FOREIGN PATENT DOCUMENTS

| | | | |
|---|---|---|---|
| JP | 10-64000 | A | 3/1998 |
| JP | 10-97697 | A | 4/1998 |
| JP | 10-241099 | A | 9/1998 |
| JP | 11-272998 | A | 10/1999 |
| JP | 11-312297 | A | 11/1999 |
| JP | 2001-351196 | A | 12/2001 |
| JP | 2003-187397 | A | 7/2003 |
| JP | 2003-256994 | A | 9/2003 |
| JP | 2004-192513 | A | 7/2004 |
| WO | WO-95/07584 | A1 | 3/1995 |
| WO | WO-01/43105 | A1 | 6/2001 |

* cited by examiner

| RADIO-TAG-AREA IDENTIFICATION NUMBER | RADIO-TAG IDENTIFICATION INFORMATION |
|---|---|
| R1 | T1 |
| R2 | T2 |
| R3 | T3 |
| R4 | T4 |
| ⋮ | ⋮ |
| R(n-1) | T(n-1) |
| Rn | Tn |

| RADIO-TAG IDENTIFICATION INFORMATION | RADIO-TAG-AREA IDENTIFICATION NUMBER |
|---|---|
| T1 | R1 |
| T2 | R2 |
| T5 | R5 |
| T6 | R6 |

| RADIO-TAG IDENTIFICATION INFORMATION | RADIO-TAG-AREA IDENTIFICATION NUMBER | STATUS (PRESENCE OF OBJECT) |
|---|---|---|
| T1 | R1 | PRESENT |
| T2 | R2 | NONE |
| T5 | R5 | NONE |
| T6 | R6 | NONE |

FIG.8

| RADIO-TAG IDENTIFICATION INFORMATION | RADIO-TAG-AREA IDENTIFICATION NUMBER | STATUS (PRESENCE OF OBJECT) | MANAGING-RADIO-TAG READER |
|---|---|---|---|
| T1 | R1 | PRESENT | 20(1) |
| T2 | R2 | NONE | 20(1) |
| T3 | R3 | NONE | 20(2) |
| T4 | R4 | PRESENT | 20(2) |
| ⋮ | ⋮ | ⋮ | ⋮ |
| T(n-1) | R(n-1) | NONE | 20(i) |
| Tn | Rn | NONE | 20(i) |

PLACE-STATUS MANAGEMENT SYSTEM, RADIO TAG READER, AND MANAGING APPARATUS

TECHNICAL FIELD

The present invention relates to a place-status management system that detects whether there is an object or a person in a predetermined place, such as a parking lot or a meeting place, to manage the status of the predetermined place, and a radio tag reader and a managing apparatus used for the place-status management system.

BACKGROUND ART

A parking lot management system is an example where a system that manages the number of objects present in a predetermined place is applied. In a parking lot management system, the number of vehicles that can enter the parking lot is managed by counting the number of vehicles entering through an entrance gate and the number of vehicles leaving through an exit gate. A control is provided so that vehicles of a number larger than the number of vehicles that can be park in the parking lot do not enter the parking lot. In this system, however, although the total number of vehicles in the parking lot can be managed, it cannot be ascertained which specific place is empty.

To ascertain the condition of parked vehicles, for example, in an indoor parking lot, a method of installing an infrared sensor on the ceiling is known. In this method, however, because a plurality of vehicles cannot be detected with one infrared sensor, due to the physical directional characteristics of infrared rays, many infrared sensors need to be installed, thereby increasing cost. If only a few sensors are installed to reduce the cost, all the parking places cannot be covered.

A conventional parking management system for solving these problems has been proposed (for example, see Patent Document 1). In this parking management system, a vehicle detector that detects presence or absence of vehicles in a parking area is movably fitted on a rail provided so as to span over a plurality of parking areas. Further, a barcode including position information of the parking area is attached to a predetermined position of the rail, so that the vehicle detector can detect the presence or absence of vehicles at predetermined positions of the parking area. In other words, when a barcode reader included in the vehicle detector reads the barcode, the vehicle detector stops and detects whether a vehicle is present or not at a position corresponding to the position of the vehicle sensor. The result is transmitted to a host computer connected to the vehicle detector, together with the position information of the parking area where the detection is performed.

Patent Document 1: Japanese Patent Application Laid-open No. H10-64000.

DISCLOSURE OF INVENTION

Problem to be Solved by the Invention

In the parking management system described in Patent Document 1, however, cost for installing the rail for moving the vehicle detector is required. Further, since the vehicle detector mechanically moves to positions where the barcode is attached to read the barcode, and detects the presence or absence of vehicles in the parking area by the vehicle sensor, time is required for detecting a vehicle, thereby deteriorating the efficiency. For example, the vehicle detector has to move to the positions of each of the parking areas to detect the presence or absence of vehicles. Therefore, considerable time is required to complete the detection of vehicles in all parking areas covered by one vehicle detector. Accordingly, the parking condition in the parking area cannot be detected in real time. On the contrary, if the parking condition in the parking area is to be obtained in real time, the coverage of one vehicle detector needs to be narrowed. The introduction cost of the parking management system then increases since many vehicle detectors are required in one parking lot.

The present invention has been made to solve the above problems, and an object of the invention is to provide a place-status management system that can quickly obtain the state of whether there is an object or a person in a predetermined place such as a parking lot at low cost, and a radio tag reader and a managing apparatus used for the place-status management system.

MEANS FOR SOLVING PROBLEM

To achieve the above objects, a place-status management system according to an aspect of the present invention that detects presence or absence of a detection object in a management area to manage a use status of the management area, includes a radio tag installed on a floor of each of a plurality of radio tag areas obtained by dividing the management area of a predetermined range by a predetermined criterion; a radio tag reader that manages the radio tags present in a communication area in which radio communication can be performed by a radio communication unit; and a managing apparatus that manages all the radio tag readers present in the management area, wherein the radio tag reader includes a radio-tag-information storage unit that stores radio-tag registration information in which a radio tag present in the communication area is associated with a radio tag area in which the radio tag is installed; and a radio-tag read processor that accesses a radio tag registered in the radio-tag registration information, to determine the presence or absence of the detection object in a radio tag area corresponding to the radio tag, and the managing apparatus includes a place-status information generator that generates place status information indicating the presence or absence of the detection object in the radio tag area in the management area, based on a result of determination made by the radio tag reading unit in the radio tag reader.

EFFECT OF THE INVENTION

According to the present invention, when there is an object or the like on a radio tag, the radio tag cannot receive a read request from a radio tag reader due to shadowing by the object, and therefore the presence or absence of an object in a radio tag area can be determined. The radio tag reader and the radio tag communicate with each other via radio, and a communication area can be optionally enlarged or narrowed by changing an output of a radio communication unit. Accordingly, the presence or absence of objects or the like on a plurality of radio tag areas can be obtained simultaneously and quickly. Since the radio tag reader need not be moved, a moving unit is not required, and the system can be configured at low cost. Further, the present invention can be introduced to an existing system, and even in this case, a wide range can be managed at low cost.

BRIEF DESCRIPTION OF DRAWINGS

FIG. 8 is an example of place status information;

EXPLANATIONS OF LETTERS OR NUMERALS

Figure 1:
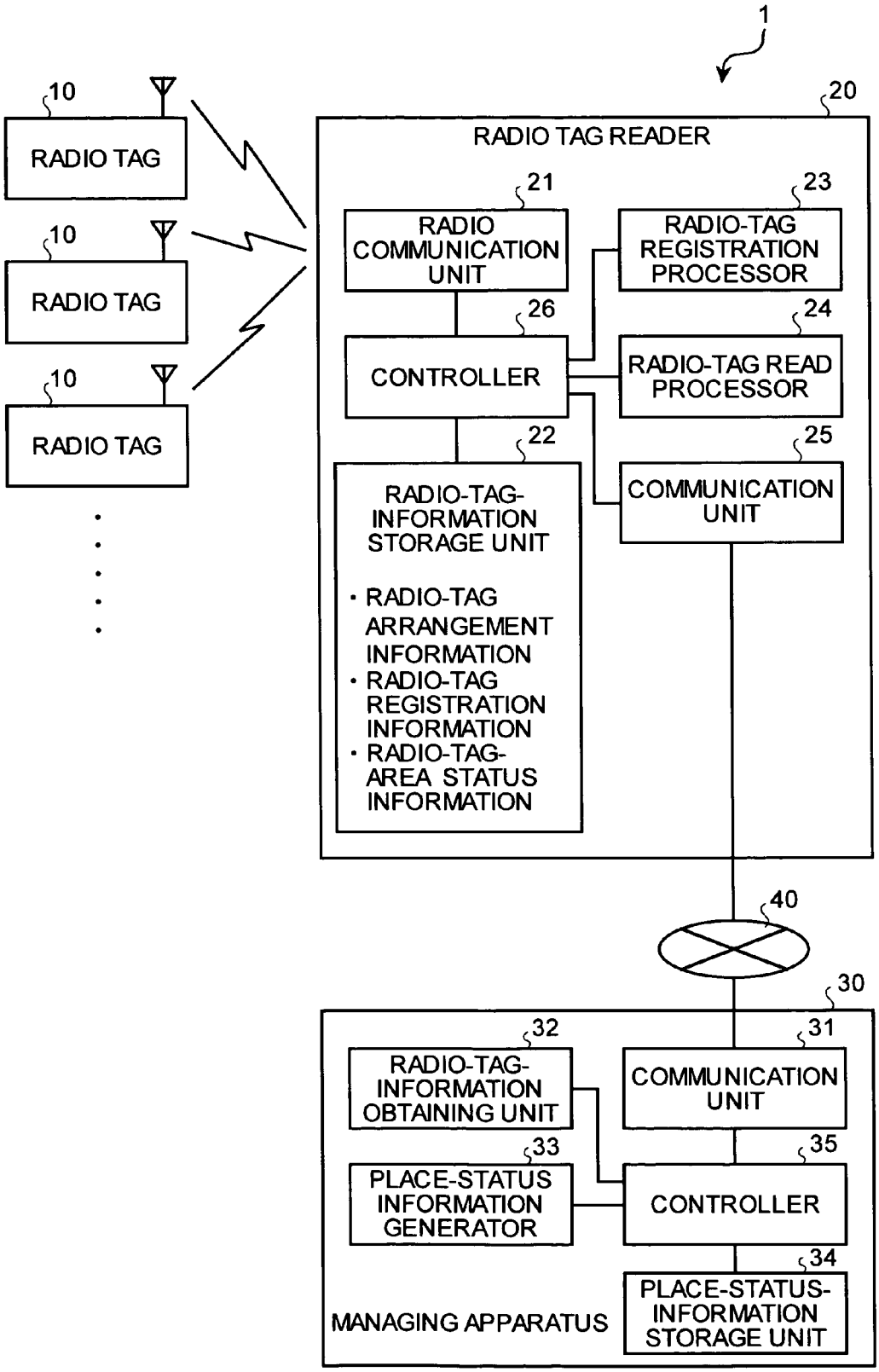
FIG. 1 is a block diagram of a schematic configuration of a place-status management system according to the present invention.

1, 1*a* Place-status management system
10 Radio tag
20 Radio tag reader
21 Radio communication unit
22 Radio-tag-information storage unit
23 Radio-tag registration processor
24 Radio-tag read processor
25, 31, 31*a*, 31*b*, 55 Communication unit
26, 35, 35*a*, 35*b*, 57 Controller
27 Display unit
30, 30*a* Managing apparatus
32 Radio-tag-information obtaining unit
33 Place-status information generator
34 Place-status-information storage unit
36 Vehicle-number calculating unit
37 Vehicle-number-information storage unit
38 Parking-lot managing unit
39 Time calculating unit
40 Communication line
51 Entrance gate
52 Exit gate
53 Blocking unit
54 Calculator
56 Display unit
100 Management area
100*a* Parking lot
101 Radio tag area (Parking space)
102 Communication area
110 Object
120 Pole
130 Attraction
131 Path
140 Display apparatus
301 Repeater
302 Parking-lot managing apparatus

BEST MODE(S) FOR CARRYING OUT THE INVENTION

Exemplary embodiments of a place-status management system, a radio tag reader, and a managing apparatus according to the present invention will be explained in detail below with reference to the accompanying drawings.

First Embodiment

FIG. 1 is a block diagram of a place-status management system according to an embodiment of the present invention. A place-status management system 1 includes a plurality of radio tags (radio frequency identification (RFID)) 10 arranged at predetermined positions in a place managed by the system (hereinafter, "management area"), a radio tag reader 20 that communicates with the radio tags 10, and a managing apparatus 30 that generates place information indicating presence of an object or a person at the predetermined position obtained from the radio tag reader 20 to manage the management area. The radio tag reader 20 and the managing apparatus 30 are connected via a communication line 40 such as a network.

The radio tag 10 includes, though not shown, a communication unit that performs radio communication with the radio tag reader 20, a storage unit that stores predetermined information relating to the radio tags 10, including identification information for identifying the radio tags 10, and a controller that performs predetermined processing in response to an instruction by a radio signal from the radio tag reader 20. The radio tags 10 are buried underground or on a floor at the predetermined position in the management area.

The radio tag reader 20 includes a radio communication unit 21 that communicates with the radio tags 10, a radio-tag-information storage unit 22 that stores information relating to the radio tags 10, a radio-tag registration processor 23 that registers radio tags 10 present in a communication area in which the radio communication unit 21 can perform radio communication, a radio-tag read processor 24 that reads the registered radio tags 10, a communication unit 25 that communicates with the managing apparatus 30, and a controller 26 that controls these respective processors. The communication area of the radio tag reader 20 need not be in one-to-one correspondence with the management area, in other words, a plurality of communication areas can be included in one management area. If there is a plurality of communication areas in the management area, a plurality of the radio tag readers 20 is provided.

The radio communication unit 21 performs the functions of converting a signal from the radio-tag registration processor 23 and the radio-tag read processor 24 to a radio signal and transmitting the radio signal, and converting the radio signal from the radio tags 10 to a signal processable in the radio-tag registration processor 23 and the radio-tag read processor 24. The range communicable by the radio communication unit 21 corresponds to the communication area of the radio tag reader 20.

The radio-tag-information storage unit 22 stores radio-tag arrangement information in which buried positions of the radio tags 10 present in the management area and identification information of the radio tags 10 are associated with each other, radio-tag registration information relating to the radio tags 10 present in the communication area, generated by the radio-tag registration processor 23 explained later, and radio-tag-area status information indicating a state of an area near the place where the radio tag 10 is buried, generated by the radio-tag read processor 24 explained later.

Figures 2, 3:
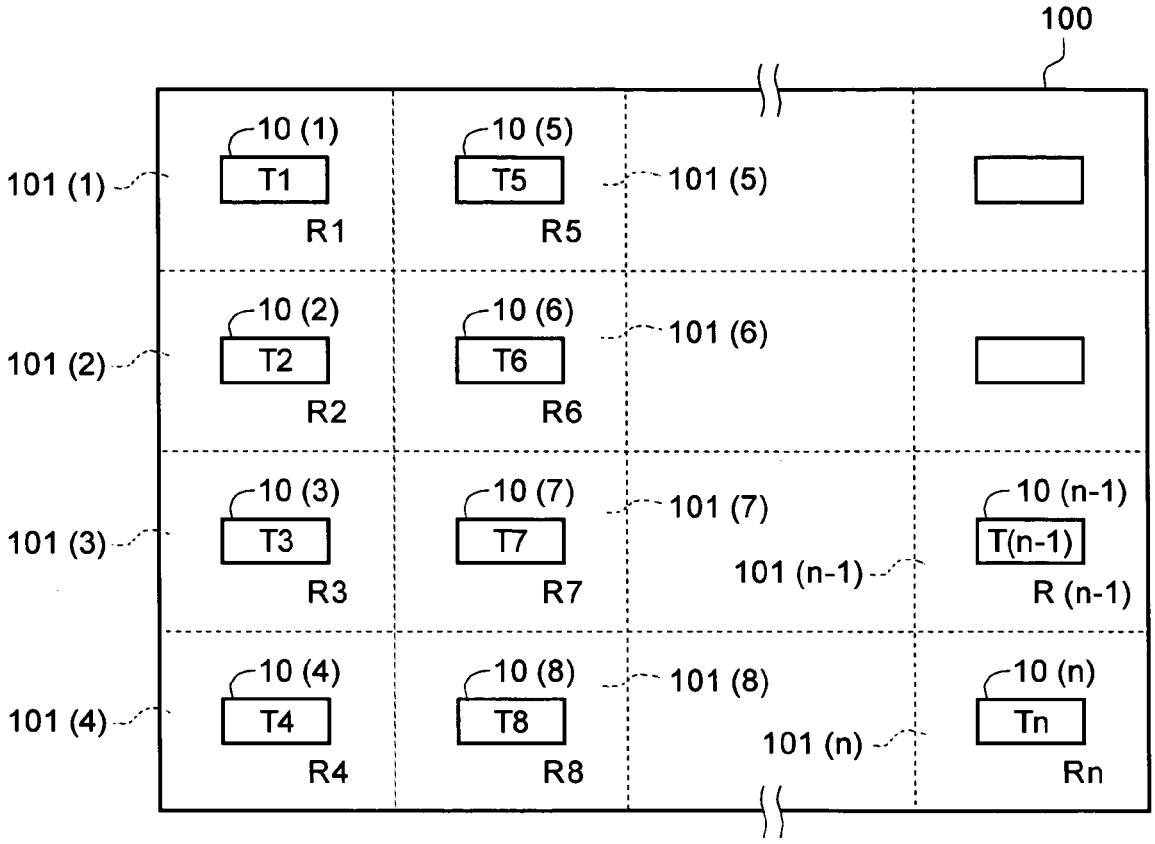
FIG. 2 schematically depicts a state of radio tags buried in a management area.
FIG. 3 is an example of a structure of radio-tag arrangement information shown in FIG. 2.

The radio-tag arrangement information is generated and set beforehand by a manager or the like of the place-status management system 1. FIG. 2 schematically depicts a state of radio tags buried in a management area, and FIG. 3 is an example of a structure of the radio-tag arrangement information shown in FIG. 2. As shown in FIG. 2, a management area 100 is divided into a plurality of areas 101(1) to 101(*n*) (n is a natural number equal to or larger than 2) of a size corresponding to the application in which the management area 100 is used. In this specification, the divided individual areas 101(1) to 101(*n*) are referred to as radio tag areas. An identification number for uniquely identifying each radio tag area 101(1) to 101(*n*) in the management area 100 is allocated to the radio tag areas 101(1) to 101(*n*). As shown in FIG. 2, it is assumed herein that identification numbers R1 to Rn are respectively added to the radio tag areas 101(1) to 101(*n*). Each one of radio tags 10(1) to 10(*n*) is buried in each of the radio tag areas 101(1) to 101(*n*). It is assumed herein that identification information T1 to Tn is set to each of the radio tags 10(1) to 10(*n*). As shown in FIG. 3, radio-tag arrangement information, which is a table in which the identification numbers R1 to Rn of the radio tag areas 101(1) to 101(*n*) are associated with the identification information T1 to Tn of the radio tags 10(1) to 10(*n*), is generated before burying the radio tags 10(1) to 10(*n*), and stored in the radio-tag-information storage unit 22 of the respective radio tag reader 20. The radio-tag registration information and the radio-tag-area status information stored in the radio-tag-information storage unit 22 are described later.

Figures 4, 5:
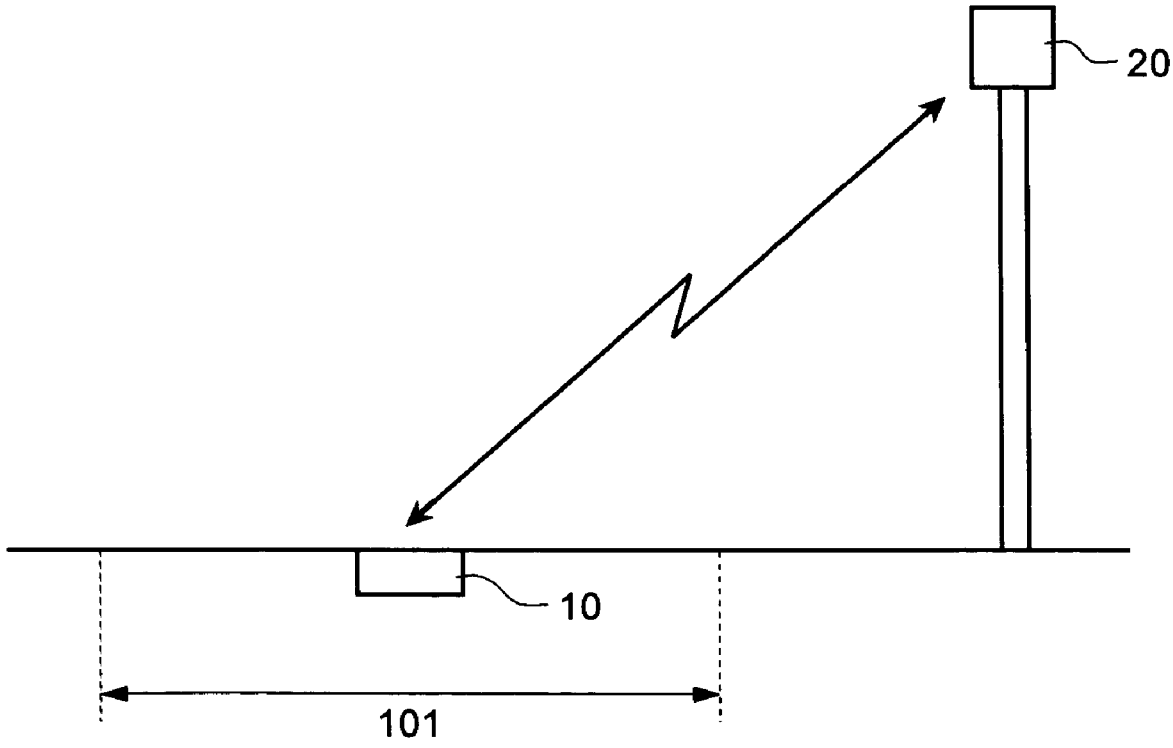
FIG. 4 is an example of radio-tag registration information.
FIG. 5 depicts a principle for determining presence or absence of an object or a person in a radio tag area by a radio-tag read processor.

The radio-tag registration processor 23 detects radio tags 10 present in the communication area of the own radio tag reader 20 to generate the radio-tag registration information, and transmits the radio-tag registration information to the managing apparatus 30. Detection of the radio tags 10 is performed by transmitting a search command of a radio tag 10 including a return request of identification information of the radio tag 10 according to, for example, a slot aloha method, in a state where there is nothing interrupting the radio communication with the radio tag 10 in the management area 100, that is, in a state where an object or a person is not present on the management area 100. The identification information of the radio tag 10 present in the communication area 102 is obtained from a response to the search command, to generate the radio-tag registration information, which is information of the radio tag 10 managed by the own radio tag reader 20. The radio-tag registration information is stored in the radio-tag-information storage unit 22. FIG. 4 is an example of the radio-tag registration information. An example in which the radio-tag registration information is formed by a combination of the identification information for identifying the radio tag 10 and an identification number of the radio tag area, in which the radio tag 10 is buried, is shown in FIG. 4.

The radio-tag read processor 24 refers to the radio-tag registration information stored in the radio-tag-information storage unit 22, to issue a read request of the identification information to the radio tag 10 buried in the communication area every predetermined time interval, to determine whether there is an object or a person in the radio tag area where the radio tag 10 is buried, according to presence or absence of response to the read request, thereby generating the radio-tag-area status information. The generated radio-tag-area status information is stored in the radio-tag-information storage unit 22.

Figures 6, 7:
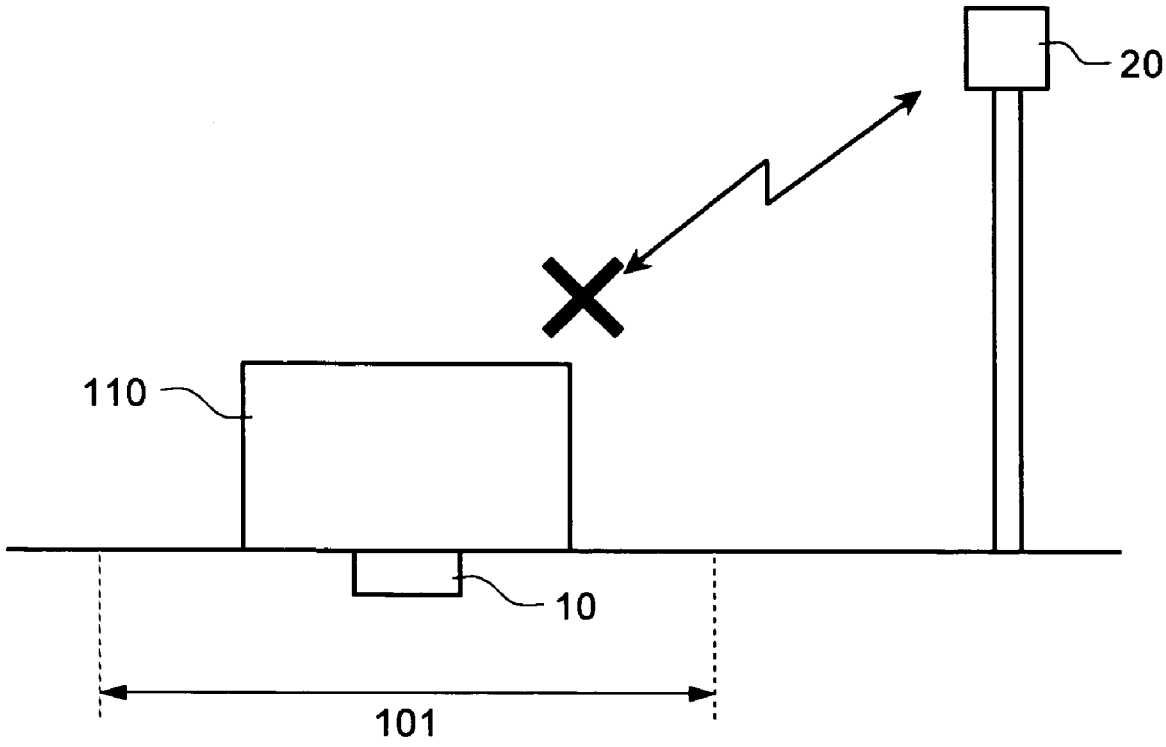
FIG. 6 depicts the principle for determining presence or absence of an object or a person in the radio tag area by the radio-tag read processor.
FIG. 7 is an example of radio-tag-area status information.

FIGS. 5 and 6 depict a principle for determining whether there is an object or a person on a radio tag area by the radio-tag read processor 24. As shown in FIG. 5, if there is no object, or a person, in the radio tag area 101, when a read request is issued to the radio tag 10 in the radio tag area 101, the radio tag 10 can receive the read request, since shadowing due to an object or a person does not occur. When the radio tag 10 receives the read request, it transmits a read response including the identification information to the radio-tag read processor 24, which receives the read response via the radio communication unit 21. In other words, if there is no object or a person in the radio tag area 101, the radio-tag read processor 24 can receive a read response from the radio tag 10, and therefore the radio-tag read processor 24 determines that there is no object or a person in the radio tag area 101. On the other hand, as shown in FIG. 6, if there is an object 110 in the radio tag area 101, even if a read request is issued to the radio tag 10 in the radio tag area 101, the radio tag 10 cannot receive the read request due to shadowing by the object. Accordingly, the radio tag 10 does not transmit a read response with respect to the read request. Therefore, when a read response cannot be received even after predetermined time has elapsed since transmission of the read request, it is determined that there is an object or a person in the radio tag area 101.

Thus, the radio-tag read processor 24 generates the radio-tag-area status information in which a determination result of each radio tag 10 in the communication area is associated with at least one of the radio tag 10 and the radio tag area 101, and stores the radio-tag-area status information in the radio-tag-information storage unit 22. FIG. 7 is an example of the radio-tag-area status information. As shown in FIG. 7, the radio-tag-area status information includes identification information of the radio tag 10, identification number of the radio tag area 101, and presence or absence of an object in the radio tag area 101.

The communication unit 25 is connected to the managing apparatus 30 via the communication line 40 such as a network, and performs a function of communicating with the managing apparatus 30. In a first embodiment, the communication unit 25 receives an instruction from the managing apparatus 30, and performs processing such as transmitting the radio-tag registration information and the radio-tag-area status information to the managing apparatus 30.

The managing apparatus 30 includes a communication unit 31 that communicates with the radio tag reader 20, a radio-tag-information obtaining unit 32 that obtains information from the radio tag reader 20, a place-status information generator 33 that generates place status information from the obtained information, a place-status-information storage unit 34 that stores the place status information, and a controller 35 that controls these respective processors.

The communication unit 31 performs a function of transmitting and receiving data between the radio tag reader 20 and the communication unit 31 via the communication line 40 such as a network. In the first embodiment, the communication unit 31 performs a function of receiving the radio-tag registration information and the radio-tag-area status information from the radio tag reader 20. The radio-tag-information obtaining unit 32 performs a function of instructing the radio tag reader 20 managed by the managing apparatus 30 to transmit the radio-tag-area status information to the managing apparatus 30 every predetermined time interval.

The place-status information generator 33 performs a function of editing the radio-tag-area status information received from the radio tag reader 20 to generate the place status information. Specifically, when a plurality of radio tag readers 20 are present in the management area, the place-status information generator 33 removes duplicate data from the radio-tag-area status information obtained from the respective radio tag readers 20, to consolidate the place status information. The place status information generated here is stored in the place-status-information storage unit 34. FIG. 8 is an example of the place status information. In the example shown in FIG. 8, the place status information includes identification information of the radio tag 10, identification number of the radio tag area 101, the status of the radio tag area 101, that is, presence or absence of an object in the radio tag area 101, and information of the radio tag reader 20 that manages the radio tag 10 (the radio tag area 101). In other words, the place status information has a structure such that the radio-tag-area status information shown in FIG. 7 is consolidated for the whole management area 100, and the information of the radio tag reader 20 that manages the respective radio tags 10 (radio tag areas 101) is added thereto. In the example shown in FIG. 8, the information for identifying the radio tag reader 20 is expressed as 20(*i*) (i is a natural number).

Figure 9:
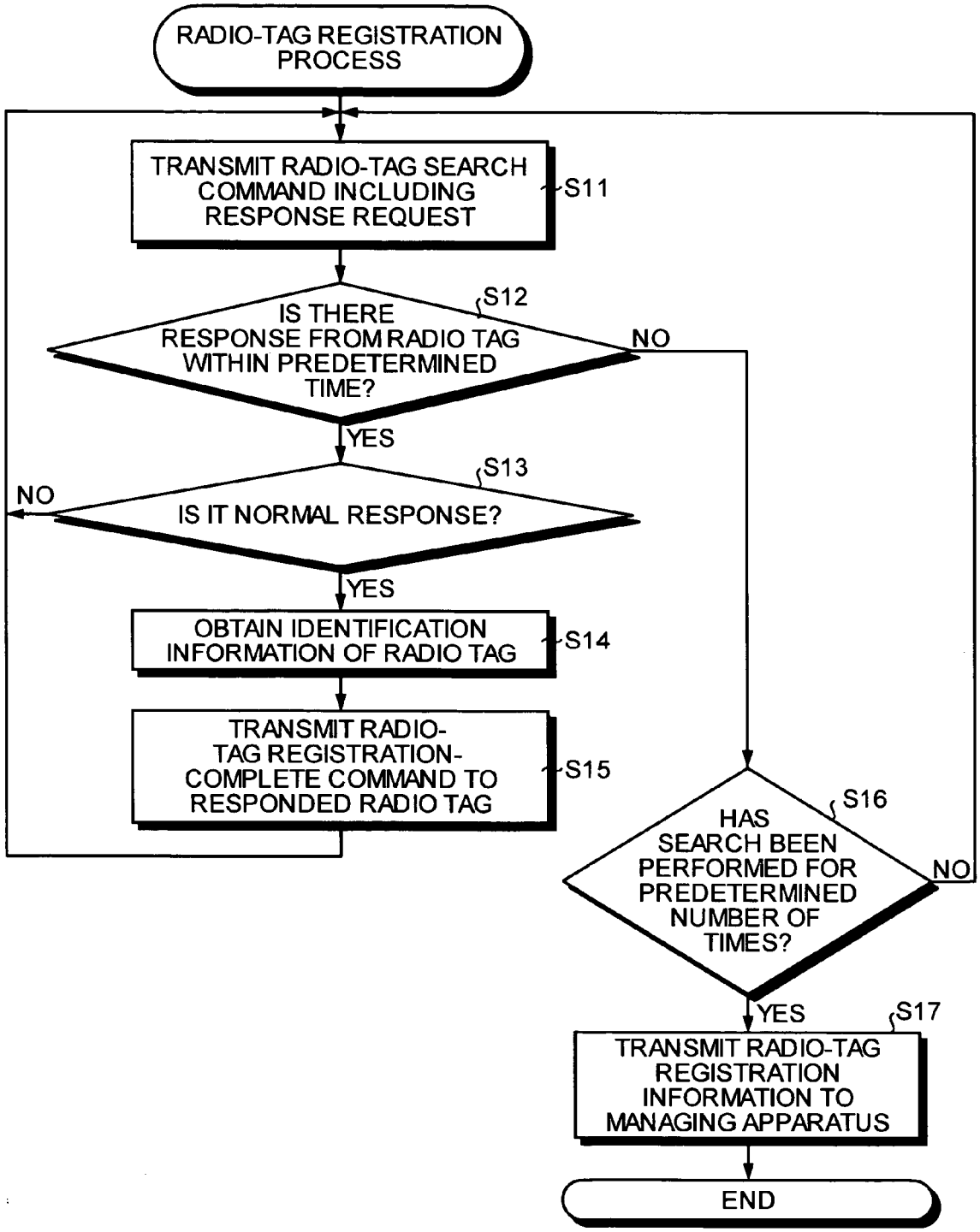
FIG. 9 is a flowchart of a radio tag registration process procedure performed by a radio tag reader.

Respective processing performed by the radio tag reader 20, the radio tag 10, and the managing apparatus 30 in the place-status management system 1 having such a configuration is explained next. First, a radio tag registration process performed by the radio tag reader is explained, with reference to the flowchart shown in FIG. 9. It is assumed here that no object or a person is present in the management area 100, at the time of executing the registration process of the radio tag 10. The radio-tag registration processor 23 in the radio tag reader 20 transmits a radio-tag search command via the radio communication unit 21 to register the radio tag 10 present in the communication area in the own radio tag reader 20 (step S11). For example, if the tag is searched by using the slot aloha method or the like at the time of search of the radio tag 10, the radio-tag registration processor 23 sets round time for radio tag search, and transmits a radio-tag search command. It is assumed here that the radio-tag search command includes a response request instructing the radio tag 10 responding to this signal to send a response including the identification information thereof.

Thereafter, the radio-tag registration processor 23 determines whether there is a response from the radio tag 10 within predetermined time after transmission of the radio-tag search command (step S12). When there is a response from the radio tag 10 within the predetermined time (step S12: Yes), the radio-tag registration processor 23 determines whether it is a normal response (step S13). The determination whether it is a normal response is performed by a check using a transmission error detection method such as a cyclic redundancy check (CRC) or a check whether there are responses from a plurality of radio tags 10 and a collision has occurred, with respect to reception data from the radio tag 10. As a result of determination, if it is a normal response (step S13: Yes), the radio-tag registration processor 23 obtains identification information of the radio tag 10 included in the reception data (step S14), and stores the identification information in the radio-tag-information storage unit 22 as radio-tag registration information, which is information of the radio tag 10 managed by the own radio tag reader 20. The radio-tag registration processor 23 then transmits a radio-tag registration-complete command to the responded radio tag 10 via the radio communication unit 21 (step S15), and returns to step S11. On the other hand, at step S13, if it is not a normal response, since an error has been detected by the transmission error detection method such as CRC, or a plurality of radio tags 10 have responded simultaneously, thereby causing a collision (step S13: No), the radio-tag registration processor 23 returns to step S11, without transmitting the radio-tag registration-complete command.

When there is no response from the radio tag 10 within the predetermined time at step S12 (step S12: No), the radio-tag registration processor 23 determines whether search has been performed for a predetermined number of times (step S16). That is, the radio-tag registration processor 23 determines whether registration of all the radio tags 10 present in the communication area has been made by performing sufficient search of the radio tags 10, or by performing search for a predetermined number of times. When search has not been performed for a predetermined number of times (step S16: No), the radio-tag registration processor 23 returns to step S11 again, to repeat the process until all the radio tags 10 present in the communication area are registered. On the other hand, when search has been performed for a predetermined number of times (step S16: Yes), the radio-tag registration processor 23 transmits the radio-tag registration information generated at this point in time to the managing apparatus 30, together with the information for identifying the own radio tag reader 20 (step S17), to finish the radio tag registration process. The managing apparatus 30 creates a table for ascertaining the radio tag area 101 (the radio tag 10) managed by the respective radio tag readers 20 from the radio-tag registration information received from the radio tag reader 20, and holds the table in the own apparatus 30.

Figure 10:
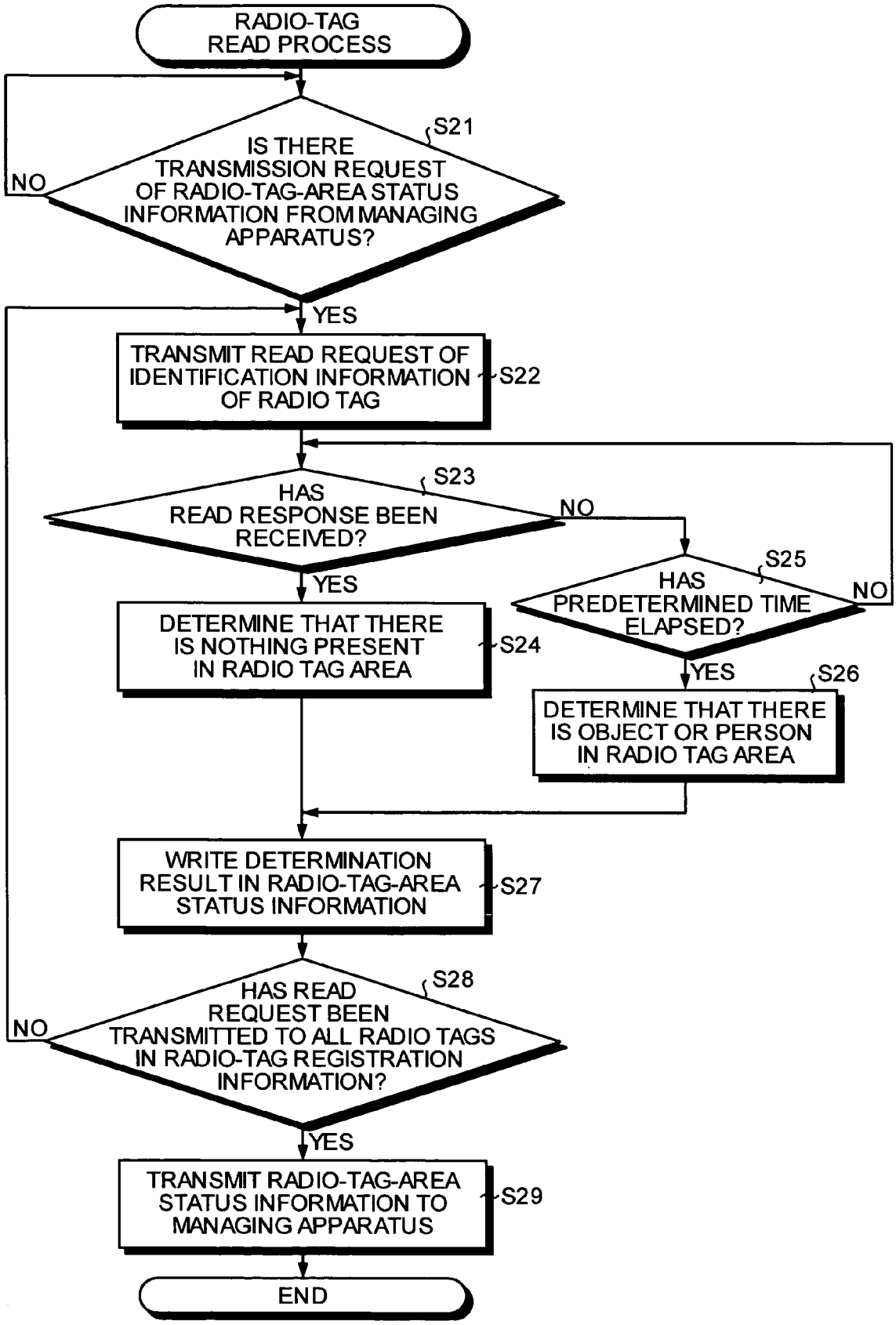
FIG. 10 is a flowchart of a radio-tag read process procedure performed by the radio tag reader.
Figure 11:
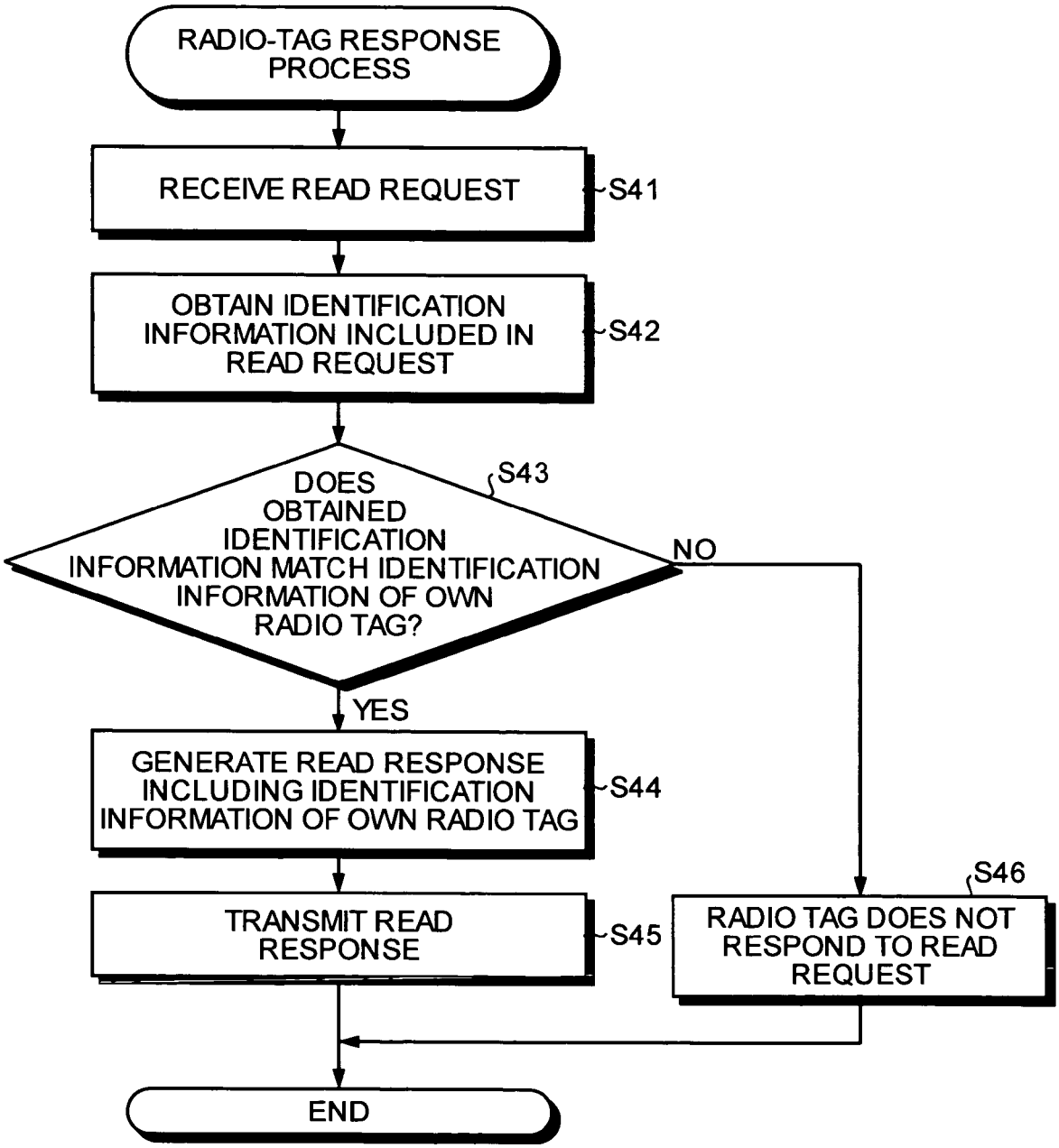
FIG. 11 is a flowchart of a response process procedure with respect to a radio tag read request.

A radio-tag read process performed by the radio tag reader 20 is explained next with reference to flowcharts shown in FIGS. 10 and 11. FIG. 10 is a flowchart of a radio-tag read process performed by the radio tag reader 20, and FIG. 11 is a flowchart of a radio-tag response process performed in response to a radio tag read request. First, the radio tag reader 20 determines whether a transmission request for transmitting the radio-tag-area status information has been received from the managing apparatus 30 (step S21), and when the transmission request of the radio-tag-area status information has not been received (step S21: No), the radio tag reader 20 enters into a waiting state. Upon reception of the transmission request of the radio-tag-area status information (step S21: Yes), the radio-tag read processor 24 transmits a read request of identification information one after another to the radio tags 10 registered in the radio-tag registration information stored in the radio-tag-information storage unit 22 (step S22). The read request includes the identification information of the radio tag 10, which performs the read process.

With reference to FIG. 11, upon reception of the read request (step S41), the radio tag 10 obtains the identification information included in the read request (step S42). The radio tag 10 then determines whether the obtained identification information matches the identification information of the own radio tag 10 (step S43). When the obtained identification information matches the identification information of the own radio tag 10 (step S43: Yes), the radio tag 10 generates a read response including the identification information of the own radio tag 10 with respect to the received read request (step S44), and transmits a read response (step S45), to finish the response process with respect to the read request. On the other hand, at step S43, when the received identification information does not match the identification information of the own radio tag 10 (step S43: No), the radio tag 10 does not respond to the read request (step S46) since it is not a read request to the own radio tag 10, and finishes the response process with respect to the read request.

After the read request is issued to the radio tags 10 as explained above, with reference back to FIG. 10, the radio-tag read processor 24 determines whether there is a read response from the radio tag 10 (step S23). When there is a read response from the radio tag 10 (step S23: Yes), the radio-tag read processor 24 determines that there is no object or the like in the radio tag area 101 in which the radio tag 10 is buried (step S24). On the other hand, when there is no read response from the radio tag 10 (step S23: No), the radio-tag read processor 24 determines whether predetermined time has elapsed since transmission of the read request to the radio tag 10 (step S25). If predetermined time has not elapsed (step S25: No), the process returns to step S23. When predetermined time has elapsed (step S25: Yes), the radio-tag read processor 24 determines that there is an object or a person in the radio tag area 101 in which the radio tag 10 is buried since there is no read response from the radio tag 10 (step S26). After the determination at step S24 or S26, the radio-tag read processor 24 writes the determination result in the radio-tag-area status information (step S27).

Thereafter, the radio-tag read processor 24 determines whether the read request has been sent to all the radio tags 10 in the radio-tag registration information (step S28). If there is a radio tag 10 to which the read request has not been sent (step S28: No), the process returns to step S22 to execute the above process with respect to another the radio tag 10. When the read request has been sent to all the radio tags 10 (step S28: Yes), the radio-tag read processor 24 transmits the radio-tag-area status information together with the information for identifying the own radio tag reader 20 to the managing apparatus 30, via the communication unit 25 (step S29). Consequently, the read process of the radio tag 10 by the radio tag reader 20 is complete.

Figure 12:
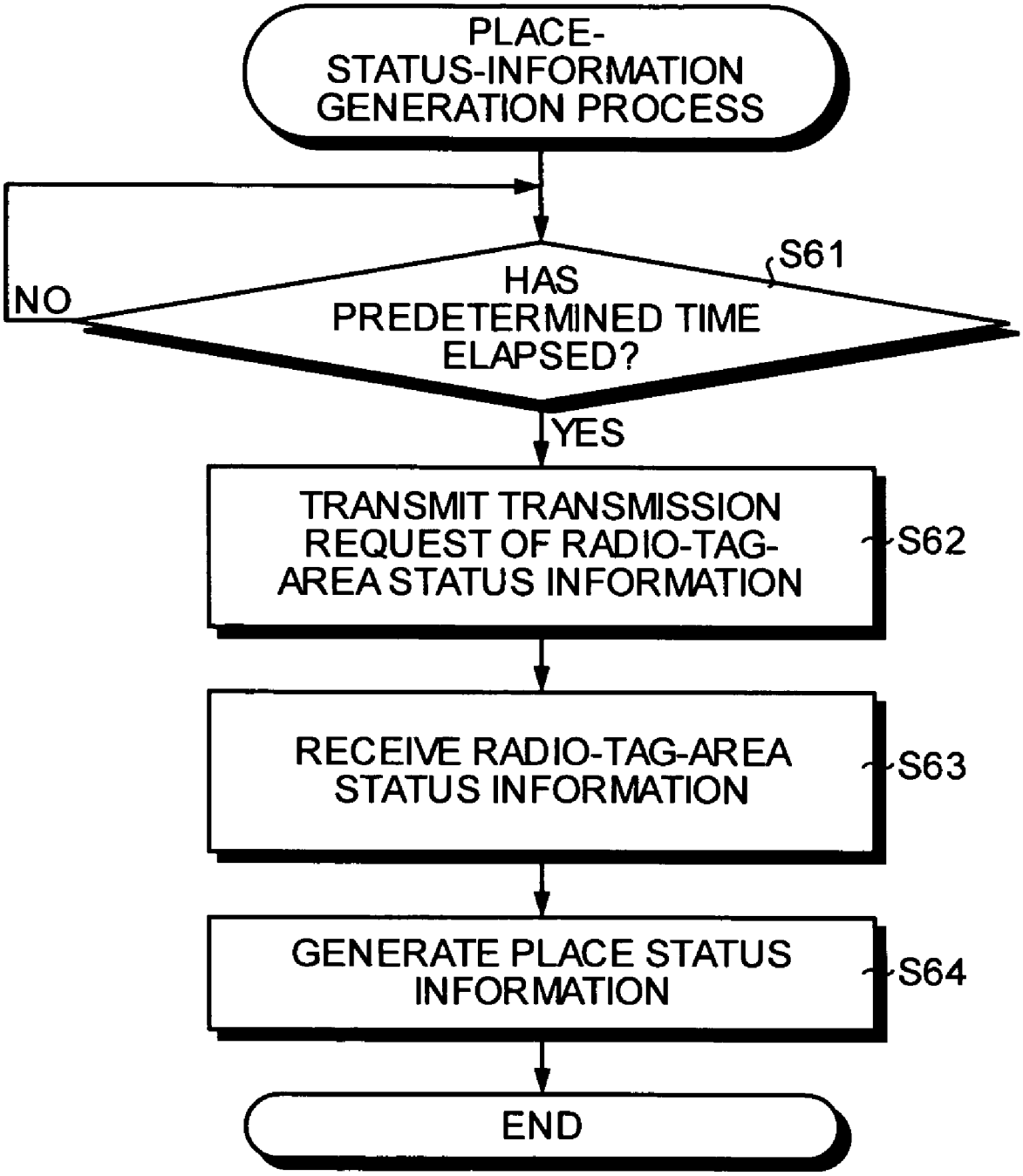
FIG. 12 is a flowchart of a place-status-information generation process procedure performed by a managing apparatus.

A place-status-information generation process performed by the managing apparatus is explained next with reference to a flowchart shown in FIG. 12. The radio-tag-information obtaining unit 32 in the managing apparatus 30 determines whether predetermined time has elapsed since the radio tag reader 20 has shifted to a state of executing the radio-tag read process (step S61). If predetermined time has not elapsed (step S61: No), the radio-tag-information obtaining unit 32 becomes a waiting state. When the predetermined time has elapsed (step S61: Yes), the radio-tag-information obtaining unit 32 transmits a transmission request of the radio-tag-area status information to the radio tag reader 20 via the communication unit 31 (step S62). When the managing apparatus 30 manages a plurality of radio tag readers 20, the radio-tag-information obtaining unit 32 transmits the transmission request of the radio-tag-area status information to all the radio tag readers 20.

Upon reception of the radio-tag-area status information from the radio tag reader 20 (step S63), the place-status information generator 33 generates place status information from the received radio-tag-area status information (step S64), and stores the place status information in the place-status-information storage unit 34 to finish the place-status-information generation process. Thereafter, the managing apparatus 30 uses the place status information to perform predetermined processing for managing the management area.

Figure 13:
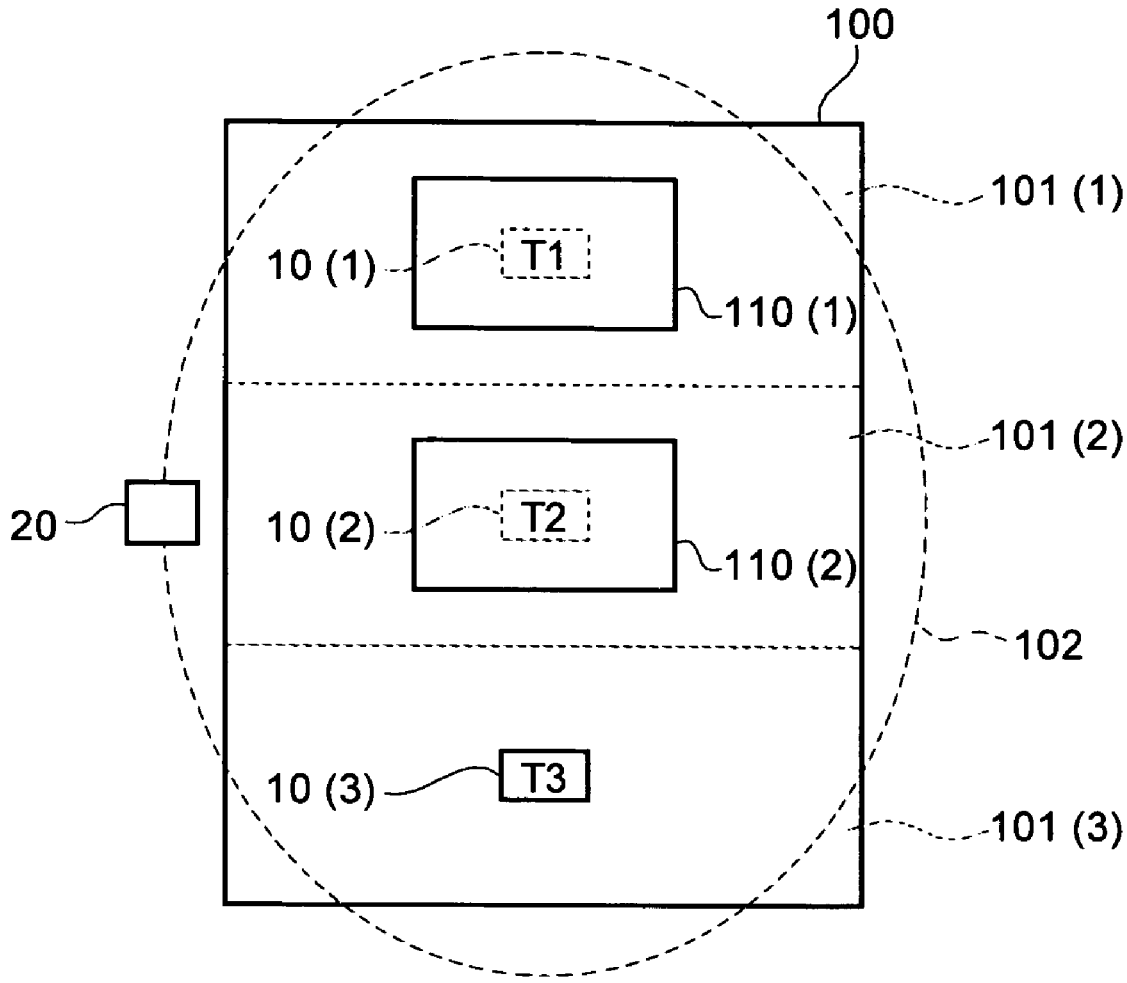
FIG. 13 is a schematic plan view of an arrangement state of an object in a management area.
Figure 14:
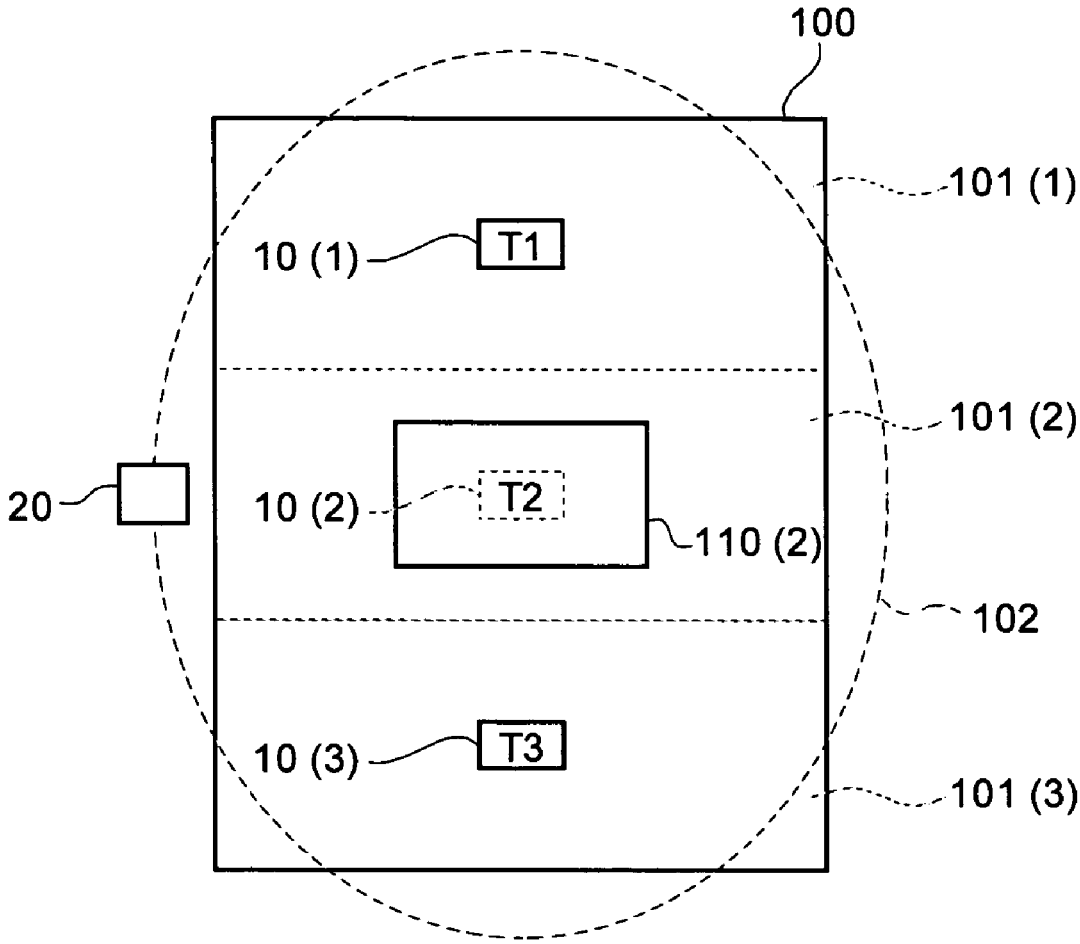
FIG. 14 is a schematic plan view of the arrangement state of the object in the management area.
Figure 15:
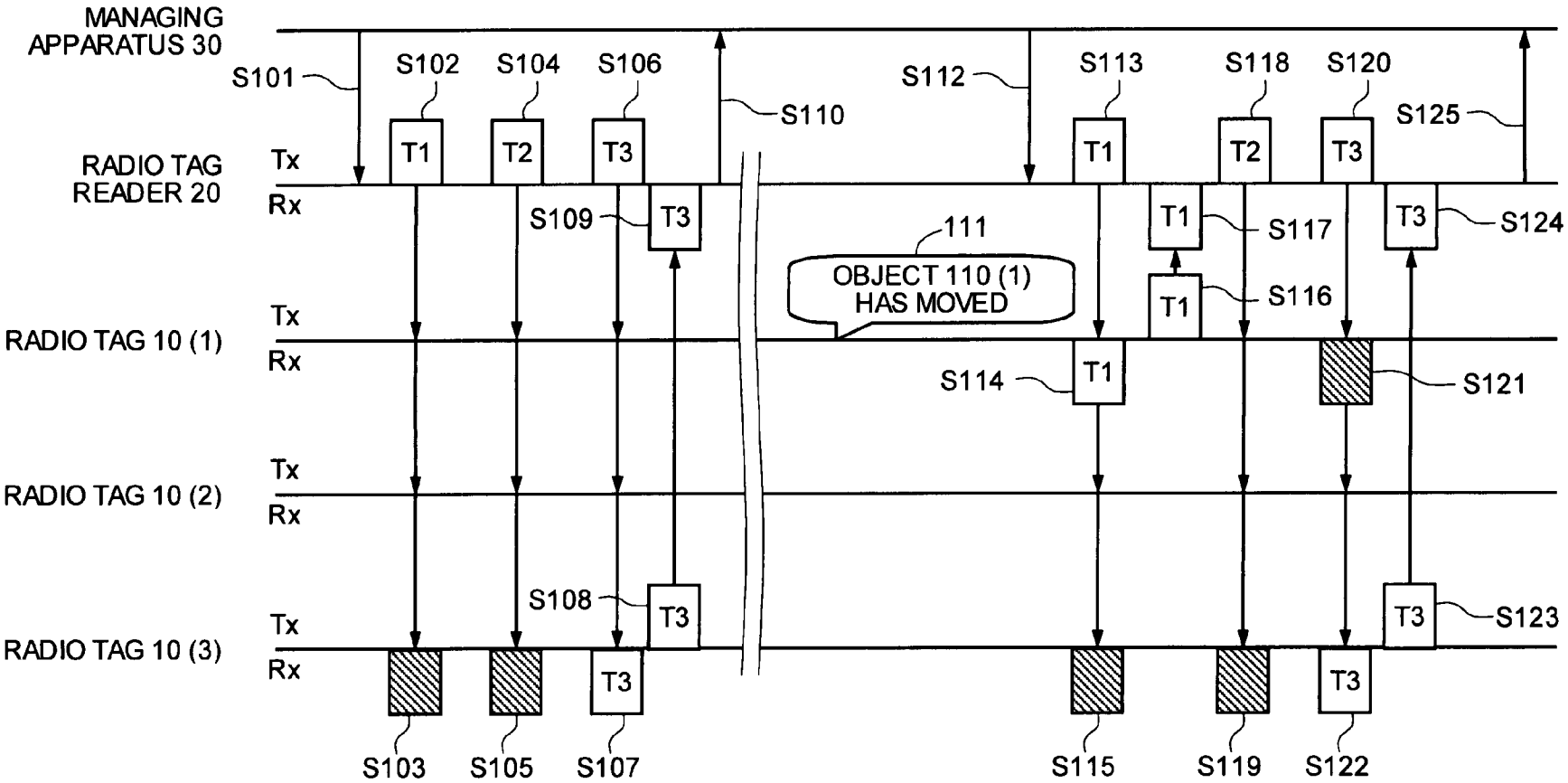
FIG. 15 is a sequence diagram of one example of a process flow of a radio tag read request when the state changes from the state shown in FIG. 13 to the state shown in FIG. 14.

A specific determination example of the state of the radio tag area by the radio tag reader is explained. FIG. 13 is a schematic plan view of an arrangement state of an object in the radio tag area of the management area at certain time. FIG. 14 is a schematic plan view of an arrangement state of an object in the radio tag area of the management area at different time. FIG. 15 is a sequence diagram of one example of a process flow of a radio tag read request when the state changes from the state shown in FIG. 13 to the state shown in FIG. 14. In the explanation below, it is assumed that the management area 100 includes three radio tag areas 101(1) to 101(3), which is a space, respectively, for temporarily placing an object 110 of a predetermined size, and a communication area 102 of the radio tag reader 20 is the entire management area 100. Radio tags 10(1) to 10(3) are respectively buried near the central part of the respective radio tag areas 101(1) to 101(3). Identification information of the radio tags 10(1) to 10(3) is assumed to be T1 to T3, respectively. In the sequence diagram shown in FIG. 15, X-axis denotes time, a rectangle written above the X-axis denotes transmission to a radio tag in the rectangle, and a rectangle written below the X-axis denotes reception by the radio tag in the rectangle. A hatched rectangle denotes a state where although a read request frame is received from the radio tag reader 20, the radio tag determines that it is not a signal directed to the own radio tag.

At first, as shown in FIG. 13, when objects 110(1) and 110(2) are respectively placed on the radio tag areas 101(1) and 101(2), a transmission request of the radio-tag-area status information is transmitted to the radio tag reader 20 from the managing apparatus 30, and the radio tag reader 20 receives the transmission request (step S101). Accompanying this, the radio tag reader 20 issues a read request sequentially to each of the radio tags 10(1) to 10(3) stored in the radio-tag registration information.

The radio tag reader 20 issues a read request including the identification information T1 first to the radio tag 10(1) (step S102). However, as shown in FIG. 13, since the radio tag 10(1) is shadowed by the object 110(1), the radio tag 10(1) cannot receive the read request from the radio tag reader 20. Likewise, since the radio tag 10(2) is shadowed by the object 110(2), the radio tag 10(2) cannot receive the read request from the radio tag reader 20. Since there is no object with respect to the radio tag 10(3) in the radio tag area 101(3), the radio tag 10(3) can receive the read request from the radio tag reader 20 directed to the radio tag 10(1). However, since it is not a read request directed to the own radio tag, the radio tag 10(3) does not respond thereto and ignore the request (step S103). Since there is no response from the radio tag 10(1) within predetermined time since transmission of the read request at step S102, the radio tag reader 20 recognizes that the radio tag 10(1) cannot communicate due to shadowing of the object 110(1), that is, there is the object 110(1) in the radio tag area 101(1).

The radio tag reader 20 then issues a read request including the identification information T2 to the radio tag 10(2). Also, in this case, as in the case of the radio tag 10(1), since there is no response from the radio tag 10(2) within predetermined time, the radio tag reader 20 recognizes that there is the object 110(2) in the radio tag area 101(2) (steps S104 and S105).

Further, the radio tag reader 20 issues a read request including the identification information T3 to the radio tag 10(3) (step S106). The radio tags 10(1) and 10(2) cannot receive the read request due to shadowing by the objects 110(1) and 110(2), respectively. On the other hand, since the radio tag 10(3) is not shadowed by an object, the radio tag 10(3) can receive the read request. Further, since the read request includes the identification information T3 of the own radio tag 10(3), the radio tag 10(3) transmits a read response including the identification information T3 of the own radio tag 10(3) (step S108). The radio tag reader 20 receives the read response from the radio tag 10(3) (step S109), thereby recognizing that there is no object in the radio tag area 101(3).

According to the above procedure, the radio tag reader 20 can ascertain whether there is an object in the radio tag areas 101(1) to 101(3) managed by the radio tag reader itself. Thereafter, the radio tag reader 20 returns the radio-tag-area status information to the managing apparatus 30 as a response of step S101 (step S110).

Thereafter, as shown in FIG. 14, it is assumed that the object 110(1) in the radio tag area 101(1) has been moved, and now an object is placed only in the radio tag area 101(2) of the radio tag areas 101(1) to 101(3) managed by the radio tag reader 20 (step S110). The managing apparatus 30 transmits again a transmission request of the radio-tag-area status information to the radio tag reader 20, after predetermined time has elapsed since the last transmission of the transmission request of the radio-tag-area status information, and the radio tag reader 20 receives this command (step S112).

As described above, the radio tag reader 20 issues a read request including the identification information T1 to the radio tag 10(1) (step S113). The radio tag 10(1) can receive the read request since it is not shadowed by a vehicle (step S114), and since the read request includes the identification information of the own radio tag 10(1), the radio tag 10(1) transmits a read response including the identification information T1 of the own radio tag 10 (step S116). Since the radio tag reader 20 receives the read response from the radio tag 10(1) (step S117), the radio tag reader 20 recognizes that there is no object in the radio tag area 101(1). The radio tag 10(2) cannot receive the read request from the radio tag reader 20 due to shadowing by the object 110(2). Although the radio tag 10(3) can receive the read request from the radio tag reader 20 (step S115) since it is not shadowed by an object, it is not a read request directed to the own radio tag 10(3), therefore, the radio tag 10(3) does not send a read response and ignores the request.

The radio tag reader 20 then issues a read request including the identification information T2 to the radio tag 10(2). Since there is no response from the radio tag 10(2) within predetermined time, the radio tag reader 20 recognizes that there is the object 110(2) in the radio tag area 101(2) (steps S118 and S119).

The radio tag reader 20 then issues a read request including the identification information T3 to the radio tag 10(3) (step S120). The radio tag 10(3) receives the read request including the identification information T3 of the own radio tag from the radio tag reader 20 (step S121), and sends a read response including the identification information T3 of the own radio tag 10 (step S123). The radio tag reader 20 receives the read response from the radio tag 10(3) (step S124), thereby recognizing that there is no object in the radio tag area 101(3). Although the radio tag 10(1) receives the read request from the radio tag reader 20 since it is not shadowed by an object, the read request is not directed to the own radio tag 10, therefore, the radio tag 10(1) does not send a read response and ignores the request (step S121). Further, since the radio tag 10(2) cannot receive the read request from the radio tag reader 20 due to shadowing by the object 110(2), the radio tag 10(2) cannot receive the read request from the radio tag reader 20.

By the above procedure, the radio tag reader 20 can ascertain whether there is an object in the radio tag areas 101(1) to 101(3) managed by the radio tag reader itself. Thereafter, the radio tag reader 20 returns the radio-tag-area status information to the managing apparatus 30 as a response of step S112 (step S125).

The above processing is performed every predetermined time interval, and the managing apparatus 30 generates the place status information, and performs predetermined processing based on the place status information. For example, the managing apparatus 30 can obtain statistical information such as use frequency of the radio tag area 101, to generate empty space information and congestion information of the radio tag area based on the statistical information. If the radio tag reader 20 stores the time at which the read process is performed in the radio-tag-area status information, the managing apparatus 30 can generate charge information with respect to a user of the radio tag area 101 according to the time used. Further, the managing apparatus 30 can ascertain replacement period of a structural object used in the place, according to the use frequency of the radio tag area 101.

In the above explanation, a radio tag can be fitted to an object placed in the radio tag area 101, and when there is no response request from the radio tag 10 fitted to a lower face of the radio tag area 101, and when another radio tag is detected by the radio tag reader 20, it can be determined that the object is placed in the radio tag area 101, from which a response request is not issued. In this case, the radio-tag read processor 24 generates the radio-tag-area status information in which the radio tag area 101 is associated with a place for placing the object. As a result, the correspondence between the radio tag area 101 and the place for placing the object becomes clear, thereby facilitating the management of objects.

In the above explanation, while generation of the radio-tag registration information in respective radio tag readers 20 is executed by the radio-tag registration processor 23, a manager or the like of the place-status management system can register beforehand which communication area of the radio tag reader 20 a buried radio tag 10 belongs to. Further, the managing apparatus 30 can be connected to a network, so that the place status information held by the managing apparatus 30 can be accessed from an information processing terminal such as a personal computer and a mobile phone. According to this configuration, the arrangement state of objects in the management area 100 can be easily recognized by an owner of the object at an optional place.

According to the first embodiment, the radio tag 10 is buried in the respective radio tag areas 101 in the management area 100, and the presence or absence of an object or a person in the radio tag area 101 is determined according to whether the radio tag reader 20 can communicate with the radio tag 10. In the communication area 102 of the radio communication unit 21 in the radio tag reader 20, a response to a signal transmitted to the radio tag 10 needs only to be obtained, and therefore the presence or absence of an object or a person can be determined instantaneously, and the place status of the management area 100 can be ascertained in real time.

The radio tag 10 is buried underground (the floor) in the management area, and the radio tag reader 20 is desirably provided at a higher position away from the ground to detect the presence or absence of an object on the radio tag 10. Accordingly, the radio tag reader 20 can be provided on an existing pole for supporting a lamp or the like installed in the management area, and therefore a special space for installing the radio tag reader 20 is not required. As a result, a wide range can be managed at low cost with respect to an existing system.

Second Embodiment

In the first embodiment, an outline of the place-status management system has been explained. In a second embodiment, an example in which the place-status management system is used for managing a parking lot is explained as a specific embodiment.

Figure 16:
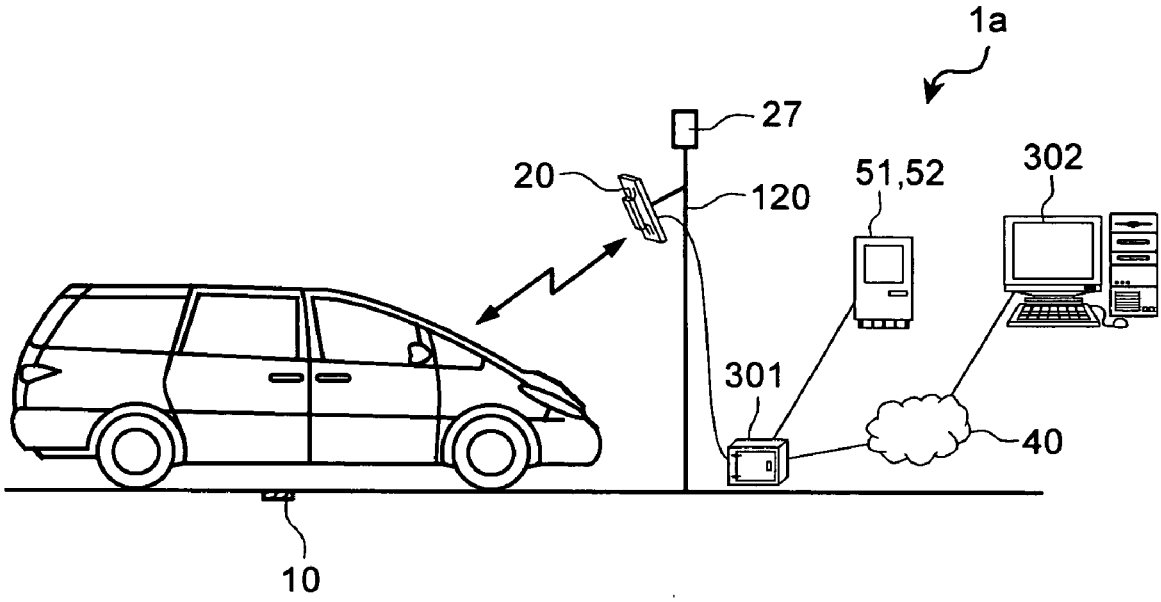
FIG. 16 schematically depicts a configuration when the place-status management system of the present invention is applied to management of a parking lot.
Figure 17:
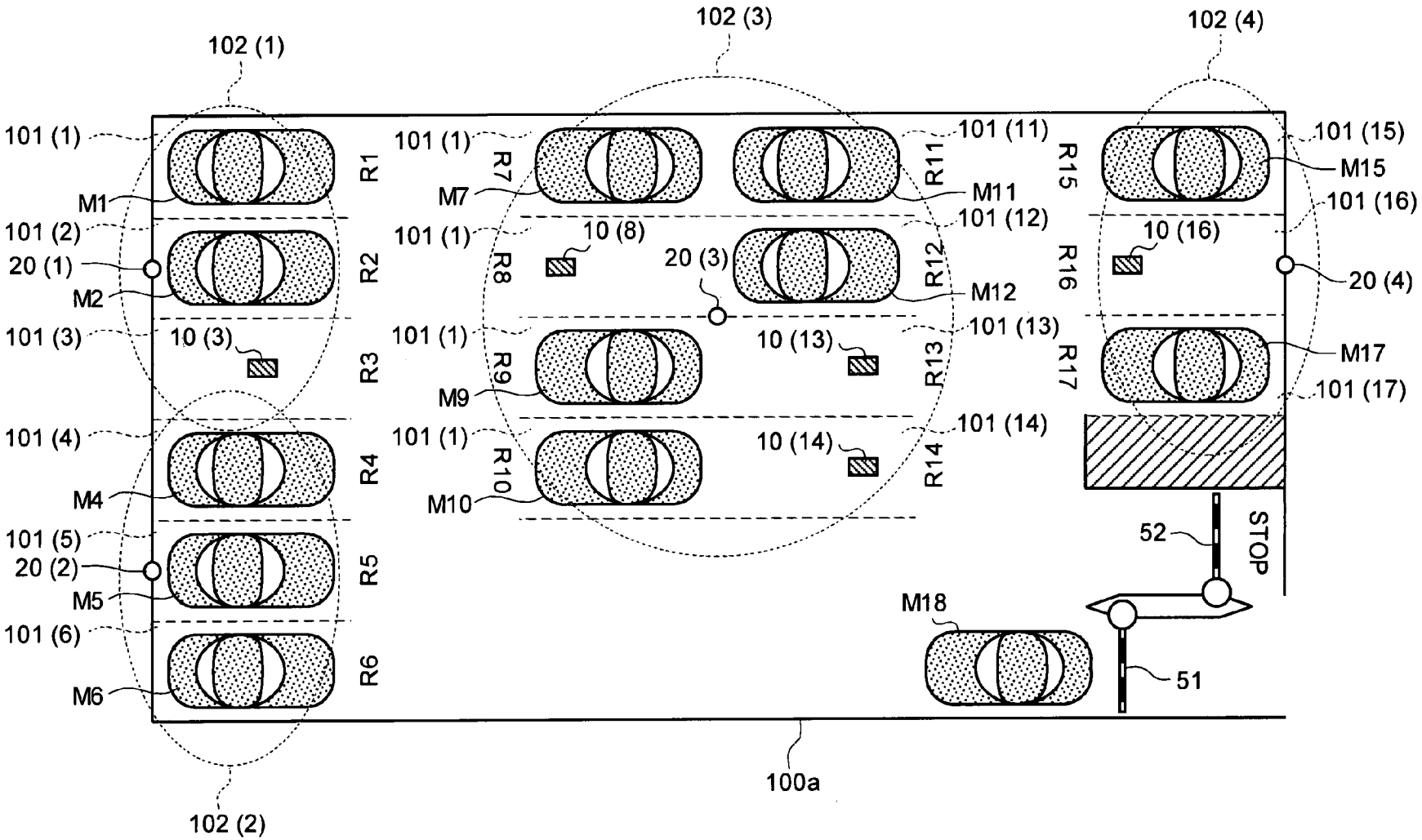
FIG. 17 schematically depicts arrangement of the radio tag reader and the radio tags in the parking lot.

FIG. 16 schematically depicts a configuration when the place-status management system of the present invention is applied to management of a parking lot. FIG. 17 schematically depicts arrangement of the radio tag reader and the radio tags in the parking lot. A place-status management system 1*a* includes a parking lot 100*a* as a management area, in which a plurality of radio tag areas 101 as a space for parking a vehicle are provided. The place-status management system 1*a* further includes the radio tag 10 buried in each radio tag area 101, a plurality of radio tag readers 20 that communicate with the radio tags 10, an entrance gate 51 and an exit gate 52 provided at a gateway of the parking lot 100*a*, a repeater 301 that collects information from the radio tag readers 20 and the entrance gate 51 and the exit gate 52, and a parking-lot managing apparatus 302 that manages the information collected by the repeater 301. The repeater 301 and the parking-lot managing apparatus 302 are connected to each other via the communication line 40 such as a network. In the second embodiment, the repeater 301 and the parking-lot managing apparatus 302 correspond to the managing apparatus 30 in the first embodiment. In the explanation below, like reference signs denote like constituent elements in the first embodiment, and explanation thereof is omitted.

The radio tag 10 is buried in each of the radio tag areas (parking space) 101 in the parking lot 100*a*. As shown in FIG. 17, it is assumed that numbers R1 to R17 are allocated to respective parking spaces, which are radio tag areas 101(1) to 101(17), as identification numbers, and identification information of the radio tags 10(1) to 10(17) to be buried in each of the radio tag areas (hereinafter, "parking spaces") 101(1) to 101(17) is set to be T1 to T17. For convenience sake, vehicles to be parked are expressed corresponding to the identification numbers of the parking spaces 101(1) to 101(17). For example, a vehicle parked in the parking space 101(1) is expressed as a vehicle M1, and a vehicle parked in the parking space 101(*j*) (j is a natural number up to 17) is expressed as a vehicle Mj. A vehicle M18 represents a vehicle just entering the parking lot.

The radio tag reader 20 is fitted to near the top of a pole 120 standing at a predetermined position in the parking lot 100*a*. In an example shown in FIG. 17, four radio tag readers are provided at four places in the parking lot 100*a* as the management area, and communication areas 102(1) to 102(4) of respective radio tag readers 20(1) to 20(4) are indicated by a circle or an ellipse drawn by dotted line. In other words, the communication area 102(1) of the radio tag reader 20(1) is the parking spaces 101(1) to 101(3), the communication area 102(2) of the radio tag reader 20(2) is the parking spaces 101(4) to 101(6), the communication area 102(3) of the radio tag reader 20(3) is the parking spaces 101(7) to 101(14), and the communication area 102(4) of the radio tag reader 20(4) is the parking spaces 101(15) to 101(17). It is assumed here that the radio tags 10 only belong to a communication area of any one of the radio tag readers 20, and there is no radio tag 10 belonging to a plurality of communication areas 102. In the second embodiment, the radio tag reader 20 includes an illumination lamp, a light-emitting diode, or a display unit 27 that can display characters.

Figure 18:
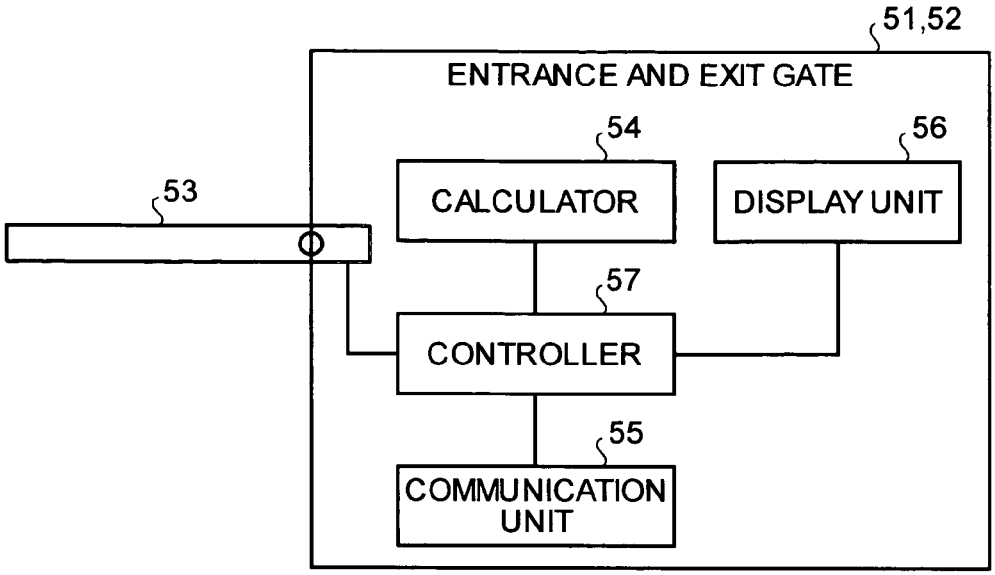
FIG. 18 is a block diagram of a schematic configuration of a gate.

The entrance and exit gates 51 and 52 are provided at positions of a gateway of the parking lot 100*a*, and manage vehicles entering or leaving the parking lot 100*a*. FIG. 18 is a block diagram of a schematic configuration of a gate. The entrance and exit gates 51 and 52 include a blocking unit 53, a calculator 54, a communication unit 55, a display unit 56, and a controller 57. The blocking unit 53 has a configuration such that a vehicle stops temporarily at a position of the gateway of the parking lot 100*a*. For example, at the time of entering the parking lot 100*a* or leaving the parking lot 10*a*, the driving path is blocked so that a vehicle cannot pass through, and is opened after the passage thereof is permitted. The calculator 54 performs a function of calculating the number of vehicles passing through the gateway by detecting the vehicle passing through the entrance and exit gates 51 and 52. The calculator 54 needs to have a configuration in which the number of vehicles entering from the entrance gate 51 and the number of vehicles leaving from the exit gate 52 can be calculated separately. The communication unit 55 performs a function of transmitting the result of calculation by the calculator 54 to the repeater 301. The display unit 56 performs a function of displaying information indicating the current congestion degree of the parking lot 100*a* and information indicating an empty position. The display unit 56 need not be provided on the exit gate 52. The controller 57 performs a function of controlling respective processors.

Figure 19:
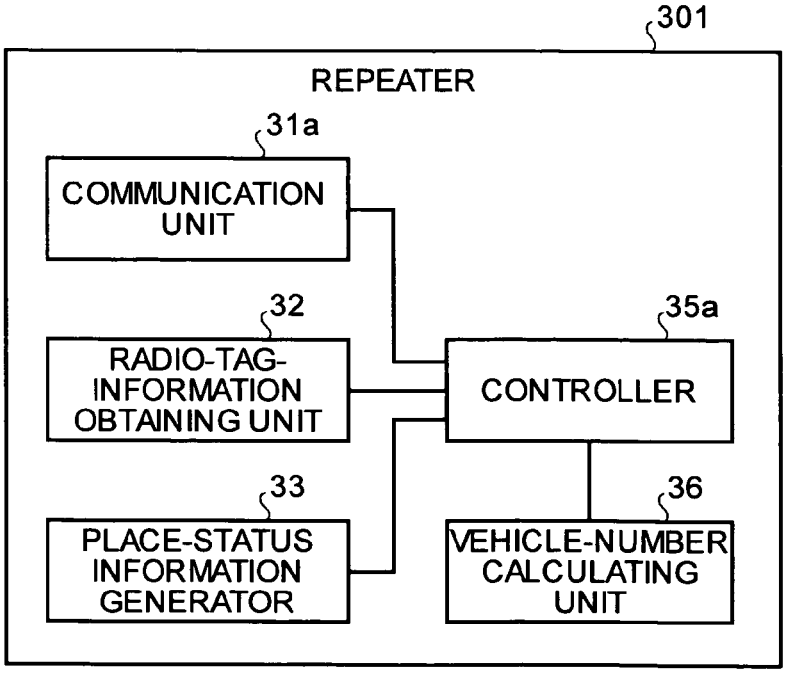
FIG. 19 is a block diagram of a schematic configuration of a repeater.

The repeater 301 collects information from the radio tag readers 20(1) to 20(4) installed in the management area (the parking lot 100*a*) and the entrance and exit gates 51 and 52 at a predetermined cycle, and outputs the collected information to the parking-lot managing apparatus 302. FIG. 19 is a block diagram of a schematic configuration of the repeater 301. The repeater 301 includes a communication unit 31*a*, the radio-tag-information obtaining unit 32, the place-status information generator 33, a vehicle-number calculating unit 36, and a controller 35*a*. The communication unit 31*a* performs a function of communicating with the radio tag readers 20(1) to 20(4) and the parking-lot managing apparatus 302. The vehicle-number calculating unit 36 calculates the number of vehicles present in the parking lot 100*a* as the management area, based on the result of calculation by the calculator 54 of the entrance an exit gates 51 and 52. Specifically, the vehicle-number calculating unit 36 calculates the number of vehicles present in the parking lot 100*a* by subtracting the number of vehicles having left the parking lot obtained from the exit gate 52 from the number of vehicles having entered the parking lot obtained from the entrance gate 51. The calculated number of vehicles is transmitted to the parking-lot managing apparatus 302 as information of the number of vehicles. Since other constituent elements are the same as respective processors constituting the managing apparatus 30 in the first embodiment, explanation thereof is omitted. The vehicle-number calculating unit 36 corresponds to an object-number calculating unit in the claims.

Figure 20:
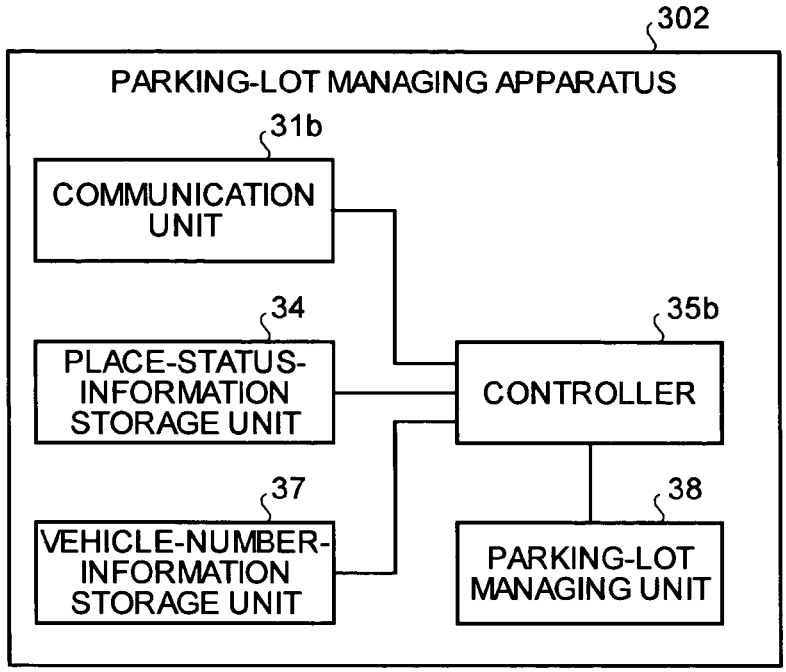
FIG. 20 is a block diagram of a configuration example of a parking-lot managing apparatus.

The parking-lot managing apparatus 302 manages the parking lot based on the information received from the repeater 301. FIG. 20 is a block diagram of a configuration example of the parking-lot managing apparatus 302. The parking-lot managing apparatus 302 includes a communication unit 31*b*, the place-status-information storage unit 34, a vehicle-number-information storage unit 37, and a parking-lot managing unit 38, and a controller 35*b*. The communication unit 31*b* performs a function of communicating with the repeater 301. The vehicle-number-information storage unit 37 performs a function of storing information of the number of vehicles in the parking lot 100*a* calculated by the repeater 301. The controller 35*b* performs a function of controlling these respective processors.

The parking-lot managing unit 38 performs a function of generating a signal for controlling the entrance and exit gates 51 and 52 and the radio tag readers 20, based on the place status information stored in the place-status-information storage unit 34 and the information of the number of vehicles stored in the vehicle-number-information storage unit 37. For example, when the number of vehicles reaches a number, which can be parked in the parking lot 100*a*, the parking-lot managing unit 38 transmits an instruction not to open the blocking unit 53 at the entrance gate 51, or when the number of vehicles decreases from the number, which can be parked in the parking lot 100*a*, transmits an instruction to open the blocking unit 53 at the entrance gate 51 to allow the vehicles to enter. Further, when a new vehicle enters from the entrance gate 51, the parking-lot managing unit 38 makes the display unit 27 of the radio tag reader 20, which manages the place including a currently empty parking space 101, light up, or makes the display unit 56 of the entrance gate 51 display the empty space. Since other constituent elements are the same as the respective processors constituting the managing apparatus 30 in the first embodiment, explanation thereof is omitted. The parking-lot managing unit 38 corresponds to a management-area managing unit in the claims.

In the place-status management system 1*a* having such a configuration, upon reception of a transmission request of the radio-tag-area status information transmitted from the repeater 301 at a predetermined cycle, the respective radio tag readers 20 generate the radio-tag-area status information based on the presence or absence of a response with respect to the read request of the radio tag 10 present in the respective communication areas 102, and transmit the radio-tag-area status information to the repeater 301. The entrance and exit gates 51 and 52 respectively calculate the number of vehicles entering into the parking lot 100*a* and the number of vehicles leaving the parking lot 100*a*, and transmit the result to the repeater 301. The repeater 301 transmits the place status information generated by collecting the radio-tag-area status information from all the radio tag readers 20(1) to 20(4) in the management area (parking lot 100*a*), and the information of the number of vehicles in the parking lot 100*a* calculated by the entrance and exit gates 51 and 52 to the parking-lot managing apparatus 302. The parking-lot managing apparatus 302 can ascertain the empty parking space 101 in the parking lot 100*a* in real time from the place status information and the information of the number of vehicles. By using the place status information and the information of the number of vehicles, the parking-lot managing apparatus 302 can display the position of the empty parking space 101 on the display unit 56 of the entrance gate 51 or the display unit 27 of the radio tag reader 20, thereby guiding the vehicle to the empty parking space 101.

In the above explanation, the radio tag 10 is buried in the parking space 101. However, by enclosing a radio tag also in a parking ticket issued at the entrance gate 51 and placing the parking ticket in the vehicle temporarily during parking, positions of the parked vehicles can be specified and stored in a database. For example, when there is no read response from the radio tag 10 in the parking space 101, which has heretofore returned the read response, and a radio tag enclosed in the parking ticket is newly detected, the parking space is associated with the enclosed radio tag and stored in the database. For example, a vehicle position guiding service can be provided by displaying the correspondence information of the parking ticket and the parking space stored in the database on a display apparatus installed in the parking lot. As a result, a user who holds the parking ticket can confirm the parking position of the own vehicle by comparing the held parking ticket with the display apparatus, when the user comes back to the parking lot. In this case, however, the radio tag reader 20 needs to perform the radio tag read request process by the radio-tag read processor 24 every predetermined time interval, and perform the radio tag registration process by the radio-tag registration processor 23 every predetermined time interval.

According to the second embodiment, by burying the radio tag 10 in the vehicle parking space 101 of the parking lot 100*a*, parking condition in the parking lot 100*a* can be ascertained in real time in a unit of parking space. By using this information, an empty parking space 101 can be provided to the vehicle entering the parking lot 10*a*, or the vehicle can be guided to the empty parking space 101.

Third Embodiment

Figure 21:
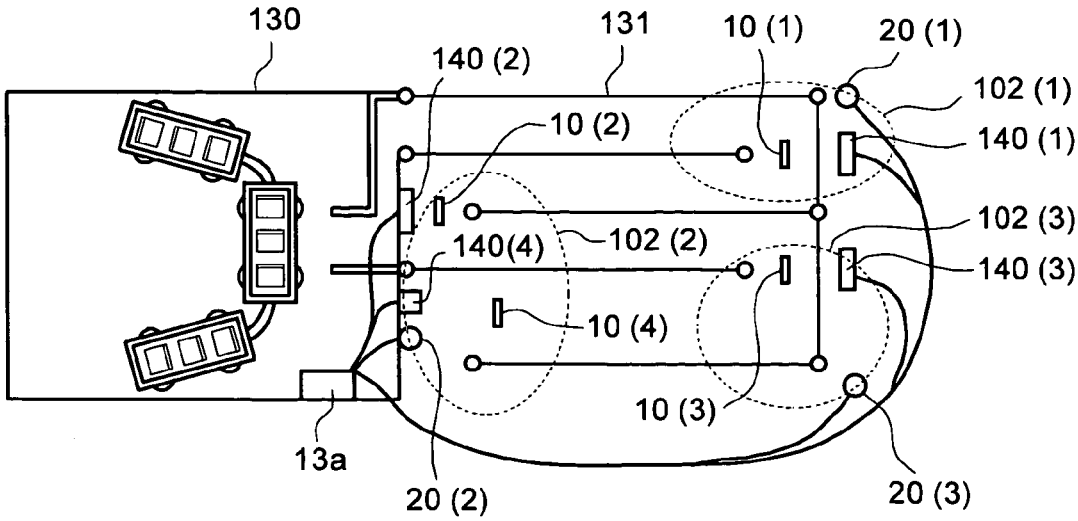
FIG. 21 depicts a configuration of a place-status management system according to a third embodiment of the present invention.

In a third embodiment, the place-status management system explained in the first embodiment is applied to waiting time management of attractions such as in an amusement park. FIG. 21 depicts a configuration of a place-status management system according to the third embodiment, and depicts a system configuration when waiting time is managed from a length of a queue formed by people waiting to enter a certain amusement facility.

The radio tags 10(1) to tag 10(4) are buried at predetermined positions of a path 131 for sequentially guiding people waiting to enter an attraction 130. In an example shown in FIG. 21, the radio tags are buried at positions of turning points of the path 131. The radio tag readers 20(1) to 20(3) are provided at positions where these radio tags 10(1) to 10(4) can be read. The communication areas 102(1) to 102(3) of the radio tag readers 20(1) to 20(3) are areas enclosed by dotted line in FIG. 21. Display apparatuses 140(1) to 140(4) such as a liquid crystal display apparatus are provided near the positions where the radio tags 10(1) to 10(4) are buried in the path 131. The radio tag readers 20 and the display apparatuses 140 are connected to a managing apparatus 30*a*.

Figure 22:
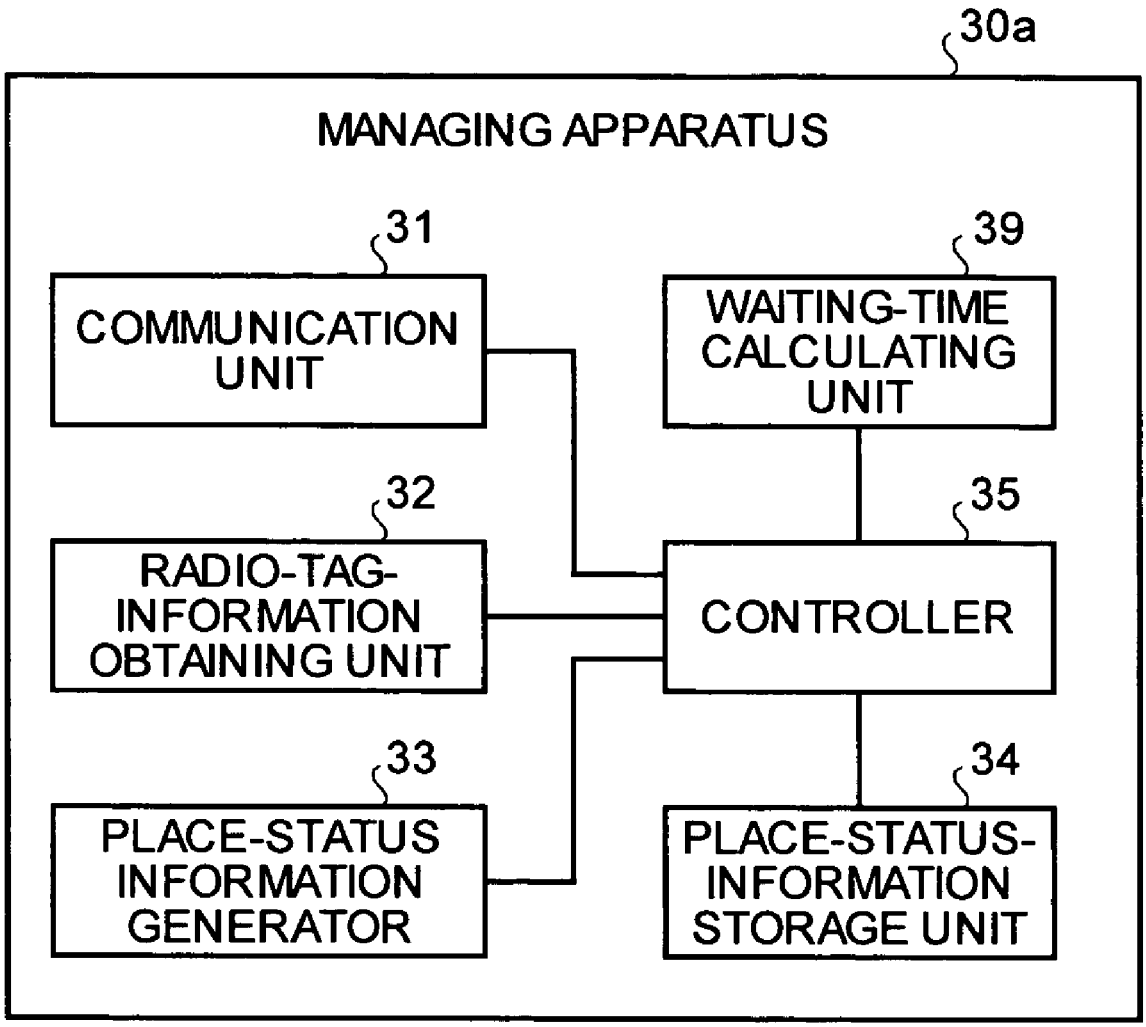
FIG. 22 is a block diagram of a schematic configuration of the managing apparatus.

FIG. 22 is a block diagram of a schematic configuration of the managing apparatus. The managing apparatus 30*a* further includes a waiting-time calculating unit 39 that calculates waiting time until entering the attraction 130, in addition to the configuration of the managing apparatus 30 shown in FIG. 1 of the first embodiment. The waiting-time calculating unit 39 performs a function of obtaining an approximate number of people waiting in the queue on the path 131 by the place status information from the respective radio tag readers 20, and calculating the waiting time by dividing the obtained approximate number of waiting people by the number of people that can enter the attraction 130 at a time, and multiplying the divided number by the time required for one attraction 130. The waiting-time calculating unit 39 also performs a function of outputting and displaying the calculated waiting time on the respective display apparatuses 140. As shown in FIG. 21, when the buried position of the radio tag 10 substantially matches the installation position of the display apparatus 140, the display apparatus 140 can display time which is time until the waiting people reach the position where the respective display apparatuses 140 are provided. In this case, the waiting time is calculated as described above by using the approximate number of people until the respective radio tags 10 (the display apparatus 140), and the result is output on the display apparatus 140 corresponding to the buried position of the radio tag 10. The waiting-time calculating unit 39 corresponds to the management-area managing unit in the claims.

Because other constituent elements are the same as in the first embodiment, detailed explanation thereof is omitted. In the third embodiment, however, the radio-tag read processor 24 in the radio tag reader 20 determines whether there is a person on the radio tag 10, and when there is no response from the radio tag 10 with respect to the read request, determines that there is a person on the radio tag 10 at that position, and when there is a response from the radio tag 10 with respect to the read request, determines that there is no person on the radio tag 10.

In the above explanation, the number of people who are waiting in a queue on the path 131 can be obtained, for example, by collecting statistics on the number of people queuing from an entrance of the attraction 130 to the respective radio tags 10 beforehand, and taking the average thereof. The waiting-time calculating unit 39 holds information relating to the number of people to the respective radio tags 10, the number of people who can enter one attraction 130, and information relating to time required for one attraction 130.

In the above explanation, while an example in which the waiting time for one attraction 130 is managed by one managing apparatus 30*a* is explained, all attractions 130 provided in the amusement park or the like can be managed by one managing apparatus 30. In this case, as explained in the second embodiment, the repeater 301 that collects information from the radio tag readers 20 is provided in each attraction 130, and the managing apparatus 30 that collects information from these repeaters 301 is provided in a management center that manages the amusement park. Further, the congestion degree of the respective attractions 130 can be displayed on the display apparatus provided in the amusement park, and congestion information indicating the congestion degree of the respective attractions 130 stored in the managing apparatus 30 can be used as a database, so that mobile information terminals such as mobile phones held by people in the amusement park can access the database.

While the waiting time of people queuing for the attraction 130 in the amusement park has been explained as an example, the present invention is not limited thereto, and the present invention is applicable to a place where congestion is anticipated at all times. The position for installing the radio tag 10 can be optional.

According to the third embodiment, the radio tag 10 is buried on the path 131 where people queue, in a place where congestion (queue) is anticipated, so as to calculate the waiting time by grasping an approximate number of people queuing on the path 131 according to the presence or absence of a response with respect to the read request from the radio tag 10. By displaying the calculated time, the waiting people can easily know how long they should wait to attain their purpose, and people who are joining the queue can decide whether to wait according to the length of the waiting time.

INDUSTRIAL APPLICABILITY

As described above, the place-status management system according to the present invention is useful, for example, for managing an empty condition of a parking lot of a supermarket or an amusement park, or managing a queue of people on a path where people queue up in a place where congestion is anticipated.

The invention claimed is:

1. A place-status management system that detects presence or absence of an object in a management area to manage a use status of the management area, the place-status management system comprising a plurality of radio tags, a plurality of radio tag readers, and a managing apparatus, wherein each of the radio tags being arranged in each of a plurality of radio tag areas obtained by dividing the management area, each of the radio tag readers being capable of performing radio communications with radio tags arranged in each of a plurality of communication areas obtained by grouping a specific number of the radio tag areas, each of the radio tag readers holding, for a corresponding communication area, radio-tag registration information indicative of a correspondence of each radio tag and a radio tag area in which the radio tag is arranged, and each of the radio tag readers performing radio communications with the radio tags arranged in the corresponding communication area based on the radio-tag registration information to thereby determine presence or absence of an object in each of the radio tag areas in the corresponding communication area, the managing apparatus generates place status information indicating the presence or absence of the object in each of the radio tag areas in the management area based on a result of determination made by each of the radio tag readers, and the radio tag reader transmits read request including identification information of a radio tag to each of the radio tags in the corresponding communication area, and determines the presence or absence of the object in a particular radio tag area based on whether there is a read response from the radio tag identified in the read request, wherein the place-status management system further includes a plurality of path radio tags arranged at a predetermined position on a path that connects to an entrance of a building and the managing apparatus includes a time calculating unit that calculates an approximate number of objects queuing on the path based on the place status information, to calculate waiting time until the objects reach the entrance by dividing the obtained approximate number of objects by the number of object that can enter the building at a time, and multiplying the divided number by the time required for the building.

2. The place-status management system according to claim 1, wherein the managing apparatus, when generating the place status information, discards duplicate information of the radio tag, when there is a radio tag belonging to communication areas of a plurality of the radio tag readers.

3. The place-status management system according to claim 1, wherein the radio tag reader includes a display unit, and the managing apparatus further includes a management-area managing unit that causes the display unit to display a radio tag area in which an object is present and a radio tag area in which an object is absent in different form which allows visual differentiation.

4. The place-status management system according to claim 1, further comprising a display apparatus that displays status of the management area based on the place status information, wherein the managing apparatus further includes a management-area managing unit that causes the display apparatus to display a radio tag area in which an object is present and a radio tag area in which an object is absent in different form which allows visual differentiation.

5. The place-status management system according to claim 4, further comprising a moveable radio tag configured to be carried by a moving object that can be removeably placed in any of the radio tag areas, the radio tag reader holds radio-tag-area status information in which the moveable radio tag attached to the object is associated with the radio tag area in which the object is placed, and the management-area managing unit displays the radio tag area in which the object is placed on the display apparatus based on the radio-tag-area status information.

6. The place-status management system according to claim 1, wherein the management area having an entrance from where the object enters the management area and an exit from where the object exits the management area, further comprising:

a entry counting unit that counts first number of objects entering the management area through the entrance;

a blocking unit configured to restrict entrance of the objects through the entrance in the management area; and an exit counting unit that counts second number of objects exiting the management area through the exit, wherein the managing apparatus further includes a calculating unit that calculates number of objects present in the management area based on the first count and the second count; and a management-area managing unit that controls the blocking unit so as to restrict entrance of the objects through the entrance in the management area if the number of objects calculated by the calculating unit is equal to a predetermined number.

7. The place-status management system according to claim 6, further comprising an entrance display unit, wherein the management-area managing unit based on the place status information causes the entrance display unit to display an empty radio tag area at a point in time when an object enters the management area through the entrance.

8. The place-status management system according to claim 1, wherein the radio tag reader includes a radio communication unit configured to perform radio communication with a plurality of radio tags, each of the radio tags being arranged in each of a plurality of radio tag areas obtained by dividing the management area, the radio communication unit capable of performing radio communications with radio tags arranged in each of a plurality of communication areas obtained by grouping a specific number of the radio tag areas, transmitting read requests including identification information of a radio tag, to each of the radio tags in the corresponding communication area, and determining the presence or absence of the object in a particular radio tag area based on whether there is a read response from the radio tag identified in a read request;

a storage unit that stores therein radio-tag registration information indicative of a correspondence of each radio tag and a radio tag area in which the radio tag is arranged; and a processing unit that accesses the radio tags registered in the radio-tag registration information to determine whether there is a object in the radio tag area corresponding to the radio tag.

* * * * *